US007736204B2

(12) United States Patent
Kaji

(10) Patent No.: US 7,736,204 B2
(45) Date of Patent: Jun. 15, 2010

(54) MARINE VESSEL RUNNING CONTROLLING APPARATUS, AND MARINE VESSEL INCLUDING THE SAME

(75) Inventor: Hirotaka Kaji, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 146 days.

(21) Appl. No.: 12/128,704

(22) Filed: May 29, 2008

(65) Prior Publication Data

US 2008/0299847 A1 Dec. 4, 2008

(30) Foreign Application Priority Data

May 30, 2007 (JP) ..... 2007-143842

(51) Int. Cl.
*B63H 21/22* (2006.01)

(52) U.S. Cl. ..... 440/1

(58) Field of Classification Search ..... 440/1
See application file for complete search history.

(56) References Cited

U.S. PATENT DOCUMENTS

| | | | | |
|---|---|---|---|---|
| 5,136,279 | A * | 8/1992 | Kanno | 340/636.1 |
| 6,431,930 | B1 | 8/2002 | Holt | |
| 6,999,836 | B2 | 2/2006 | Schwarm et al. | |
| 7,124,014 | B1 | 10/2006 | Ishida et al. | |
| 7,280,904 | B2 | 10/2007 | Kaji | |
| 2005/0092225 | A1 | 5/2005 | Kaji et al. | |
| 2008/0009993 | A1 * | 1/2008 | Matsuda et al. | 701/41 |

FOREIGN PATENT DOCUMENTS

| | | | |
|---|---|---|---|
| CN | 1619440 | A | 5/2005 |
| JP | 10-9012 | A | 1/1998 |
| JP | 2001-298614 | A | 10/2001 |
| JP | 2004-126868 | A | 4/2004 |
| JP | 2005-240576 | A | 9/2005 |
| JP | 2006-293483 | A | 10/2006 |

OTHER PUBLICATIONS

Kaji; "Marine Vessel Running Controlling Apparatus, and Marine Vessel Including the Same"; U.S. Appl. No. 11/612,597, filed Dec. 19, 2006.

Official Communication issued in corresponding Chinese Patent Application No. 200610168783X, mailed on Nov. 20, 2009.

* cited by examiner

*Primary Examiner*—Stephen Avila
(74) *Attorney, Agent, or Firm*—Keating & Bennett, LLP

(57) ABSTRACT

A marine vessel running controlling apparatus is applicable to a marine vessel which includes a propulsive force generating unit having an engine with an electric throttle as a drive source for generating a propulsive force to propel a hull of the marine vessel. The marine vessel running controlling apparatus includes an operational unit to be operated by an operator of the marine vessel for controlling the propulsive force, and a control unit arranged to acquire a normal data sample by eliminating an abnormal data sample from actual data acquired during travel of the marine vessel and update control information related to an opening degree of the electric throttle with respect to an operation amount of the operational unit based on the normal data sample.

10 Claims, 29 Drawing Sheets

(1) LOWER SPEED CHARACTERISTIC OPERATING REGION
(2) INFLECTION POINT OPERATING RESION
(3) HIGHER SPEED CHARACTERISTIC OPEERATING REGION

MARINE VESSEL RUNNING CONTROLLING APPARATUS, AND MARINE VESSEL INCLUDING THE SAME

BACKGROUND OF THE INVENTION

1. Field of the Invention

The present invention relates to a marine vessel which includes a propulsive force generating unit having an engine with an electric throttle as a drive source, and a marine vessel running controlling apparatus for such a marine vessel.

2. Description of the Related Art

An exemplary propulsion system provided in a marine vessel such as a cruiser or a boat for a leisure purpose is an outboard motor attached to a stern (transom) of the marine vessel. The outboard motor includes a propulsion unit provided outboard of the vessel. A steering mechanism is attached to the propulsion unit. The propulsion unit includes an engine as a drive source and a propeller as a propulsive force generating member. The steering mechanism horizontally turns the entire propulsion unit with respect to a hull of the marine vessel.

A control console for controlling the marine vessel is provided on the hull. The control console includes, for example, a steering operational section for performing a steering operation, and a throttle operational section for controlling the output of the outboard motor. The throttle operational section includes, for example, a throttle lever (remote control lever) to be operated forward and reverse by an operator of the marine vessel. The throttle lever is mechanically connected to a throttle of the engine of the outboard motor via a wire. Therefore, the output of the engine is controlled by operating the throttle lever. A relationship between the operation amount (operation position) of the throttle lever and the throttle opening degree is constant.

In a typical engine, a relationship between an engine speed and the throttle opening degree is nonlinear. In a lower throttle opening degree range of the typical engine, as shown in FIG. 33, the engine speed steeply increases with an increase in the throttle opening degree. In a higher throttle opening degree range of the engine, the engine speed moderately increases with the increase in the throttle opening degree. This tendency is particularly remarkable in the case of a throttle including a butterfly valve. A throttle employing ISC (Idle Speed Control) also exhibits this tendency to some degree.

Particularly, such a nonlinear characteristic significantly influences the control of a small-scale marine vessel including an outboard motor having no speed change gear. More specifically, as shown in FIG. 34, a resistance received by the marine vessel from a water surface is relatively small in a lower speed range, and varies in a complicated manner due to a frictional resistance and a wave-making resistance. In addition, the engine speed is steeply changed in response to a slight throttle operation, so that a propulsive force generated by the outboard motor is liable to be changed. When fine control of the propulsive force is required, for example, when the marine vessel is moved toward or away from a docking site or moved to different fishing points, a higher level of marine vessel maneuvering skill is required. Therefore, an unskilled operator of a leisure boat or the like cannot easily control the throttle lever when moving the boat toward or away from a docking site.

On the other hand, the engine is required to have higher responsiveness in a middle-to-high speed range which is higher than a hump range (corresponding to an engine speed of about 2,000 rpm at which a maximum wave-making resistance is observed). This is because the marine vessel is preferably quickly brought into a smooth traveling state (planing state) out of the hump range and has higher responsiveness for traveling over surges in the ocean. Therefore, the engine speed is required to be quickly changed in response to the operation of the throttle lever in the middle-to-high engine speed range. However, the throttle opening degree-engine speed characteristic shown in FIG. 33 does not meet this requirement.

In the automotive field, electric throttles have recently been used, which are driven by an actuator according to an accelerator operation amount detected by a potentiometer. It is conceivable to use such an electric throttle for the engine output control of the propulsion system such as the outboard motor. In this case, the throttle lever operation amount-throttle opening degree characteristic, which is defined as a fixed linear relationship in the prior art arrangement having the throttle lever and the throttle mechanically connected to each other, can be flexibly modified. For example, the operation amount-throttle opening degree characteristic can be nonlinear. Therefore, the marine vessel maneuvering characteristic for lower speed traveling (with a lower throttle opening degree) can be improved, for example, by properly setting the operation amount-throttle opening degree characteristic.

SUMMARY OF THE INVENTION

In order to overcome the problems described above, a preferred embodiment of the present invention provides a marine vessel running controlling apparatus for a marine vessel which includes a propulsive force generating unit having an engine with an electric throttle as a drive source for generating a propulsive force to propel a hull of the marine vessel. The marine vessel running controlling apparatus includes an operational unit to be operated by an operator of the marine vessel for controlling the propulsive force, and a control unit arranged to acquire a normal data sample by eliminating an abnormal data sample from actual data acquired during travel of the marine vessel and update control information related to an opening degree of the electric throttle with respect to an operation amount of the operational unit based on the normal data sample.

With this unique arrangement, a relationship between the operation amount of the operational unit and the throttle opening degree (operation amount-throttle opening degree characteristic) is determined based on the actual data acquired during the travel of the marine vessel having the propulsive force generating unit incorporated in the hull thereof. The electric throttle is controlled based on the operation amount-throttle opening degree characteristic thus determined, whereby a relationship between the operation amount of the operational unit and an engine output (operation amount-engine output characteristic) can be adapted for an operator's preference. This facilitates a marine vessel maneuvering operation when fine control of the throttle is required in a lower engine output state, for example, for moving the marine vessel toward or away from a docking site or for trolling. In a higher engine output state, the engine output can be changed with higher responsiveness to the operation of the operational unit.

The operation amount-throttle opening degree characteristic is determined based on the normal data sample acquired by eliminating the abnormal data sample from the actual data. This makes it possible to properly determine the operation amount-throttle opening degree characteristic while eliminating any influences of the abnormal data sample. Thus, improperly setting of the operation amount-engine output characteristic is substantially prevented.

As a result, the marine vessel maneuverability is improved.

The marine vessel running controlling apparatus may further include an abnormal drive judging unit arranged to judge whether the engine is in an abnormal drive state. In this case, the control unit preferably includes an actual data eliminating unit arranged to eliminate an actual data sample acquired in a period during which the abnormal drive judging unit judges that the engine is in the abnormal drive state.

With this unique arrangement, the actual data sample acquired in the period during which the abnormal drive judging unit judges that the engine is in the abnormal drive state is eliminated. Therefore, a possibly abnormal data sample is eliminated from the actual data, so that the operation amount-throttle opening degree characteristic is determined based on the remaining normal data sample. This substantially prevents the abnormal data sample from being used for the determination of the operation amount-throttle opening degree characteristic. Thus, the operation amount-throttle opening degree characteristic is determined based on the normal data sample.

The actual data eliminating unit may include an actual data acquisition prohibiting unit arranged to prohibit the acquisition of the actual data sample in the period during which the abnormal drive judging unit judges that the engine is in the abnormal drive state. Thus, the possibly abnormal data sample is preliminarily eliminated from the actual data. Alternatively, the actual data eliminating unit may be arranged to acquire the actual data sample during the period in which the abnormal drive judging unit judges that the engine is in the abnormal drive state, and eliminate the actual data sample acquired during this period from the actual data. Thus, the possibly abnormal data sample is eliminated after the acquisition of the actual data.

The control unit may be arranged to determine the operation amount-throttle opening degree characteristic based on a representative value of actual data excluding the actual data sample acquired in the period during which the engine is in the abnormal drive state. In this case, examples of the representative value include an average and a median (center value).

The abnormal drive state of the engine is attributable, for example, to the over-rev of the engine occurring due to free rotation of a propeller (sudden reduction in load) or to knocking. The free rotation of the propeller is liable to occur when the propeller is exposed in air due to lift-off of the hull out of the water or when a load applied to the propeller is suddenly removed due to cavitation.

The control unit may include a median computing unit arranged to compute a median of the actual data. In this case, the control unit is preferably arranged to update the control information related to the opening degree of the electric throttle with respect to the operation amount of the operational unit based on the median computed by the median computing unit. The median (center value) of the actual data is herein defined as an actual data sample which is located at a center in a sequence of to-be-processed actual data samples arranged in order of increasing magnitude.

With this unique arrangement, an abnormal data sample falling outside a distribution of normal data samples is eliminated by determining the median of the actual data. Even if the abnormal data sample is included in the actual data acquired during the travel of the marine vessel, the abnormal data sample can be eliminated after the acquisition of the actual data, because the median is one of the normal data samples. Thus, the operation amount-throttle opening degree characteristic is determined based on the median (normal data sample).

The control unit may include a trimmed mean computing unit arranged to compute a trimmed mean of the actual data. In this case, the control unit is preferably arranged to update the control information related to the opening degree of the electric throttle with respect to the operation amount of the operational unit based on the trimmed mean computed by the trimmed mean computing unit. The trimmed mean (harmonic mean) is herein defined as an average of actual data excluding a predetermined number of actual data samples or a predetermined range of actual data samples located in each of opposite end regions of an actual data distribution.

With this unique arrangement, an abnormal data sample falling outside a distribution of normal data samples is eliminated by determining the trimmed mean of the actual data. Even if the abnormal data sample is included in the actual data acquired during the travel of the marine vessel, the abnormal data sample is eliminated after the acquisition of the actual data, because the trimmed mean is an average of the normal data samples. Thus, the operation amount-throttle opening degree characteristic is determined based on the trimmed mean which is the average of the normal data samples.

The control unit may include an average computing unit arranged to compute an average of actual data to be processed, a standard deviation computing unit arranged to compute a standard deviation of the to-be-processed actual data, and a to-be-processed actual data updating unit arranged to update the to-be-processed actual data by eliminating from the to-be-processed actual data an actual data sample deviating from the average by a distance which is not less than a predetermined integer multiple of the standard deviation (e.g., by a distance which is one or more times the standard deviation). In this case, the control unit is preferably arranged to update the control information related to the opening degree of the electric throttle with respect to the operation amount of the operational unit based on the to-be-processed actual data updated by the to-be-processed actual data updating unit. In this case, the control unit may determine the operation amount-throttle opening degree characteristic based on a representative value of the to-be-processed actual data updated by the to-be-processed actual data updating unit. Where the average of the to-be-processed actual data is used as the representative value, the control unit preferably further includes an average updating unit arranged to update the average based on the to-be-processed actual data updated by the to-be-processed actual data updating unit.

With this unique arrangement, the to-be-processed actual data updating unit updates the to-be-processed actual data by eliminating from the to-be-processed actual data the actual data sample deviating from the average by the distance which is not less than the predetermined integer multiple of the standard deviation. This makes it possible to eliminate the abnormal data sample from the to-be-processed actual data, thereby substantially preventing the abnormal data sample from being used for the determination of the operation amount-throttle opening degree characteristic.

When the average of the to-be-processed actual data is updated based on the updated to-be-processed actual data, for example, the updated average is an average of normal data samples. Even if the abnormal data sample is included in the actual data, the abnormal data sample is eliminated after the acquisition of the actual data, and the operation amount-throttle opening degree characteristic is determined based on the normal data samples.

The control unit may further include an average updating unit arranged to update the average based on the to-be-processed actual data updated by the to-be-processed actual data updating unit, and a standard deviation updating unit arranged to update the standard deviation based on the to-be-processed actual data updated by the to-be-processed actual data updating unit. In this case, the to-be-processed actual data updating unit is preferably arranged to further update the to-be-processed actual data based on the average updated by the average updating unit and the standard deviation updated by the standard deviation updating unit.

With this unique arrangement, when the to-be-processed actual data is updated and the average of the to-be-processed actual data is updated based on the updated to-be-processed actual data, the updated average is closer to the center of the normal data distribution than the previous average. When the to-be-processed actual data is updated and the standard deviation of the to-be-processed actual data is updated based on the updated to-be-processed actual data, the updated standard deviation is smaller than the previous standard deviation. By further updating the to-be-processed actual data based on the average and the standard deviation thus updated, the abnormal data sample can be reliably eliminated from the to-be-processed actual data. Further, a normal data sample located apart from the center of the normal data distribution (hereinafter referred to as "outlier data sample") can be also eliminated. This makes it possible to extract normal data samples located closer to the center of the normal data distribution (more reliable normal data samples). Therefore, the operation amount-throttle opening degree characteristic is more properly determined based on the more reliable normal data samples.

The control unit may be arranged to repeatedly cause the average updating unit, the standard deviation updating unit and the to-be-processed actual data updating unit to update the average, the standard deviation and the to-be-processed actual data, respectively, until no actual data sample deviates from the updated average by a distance which is not less than the predetermined integer multiple of the updated standard deviation.

With this unique arrangement, the abnormal data sample and the outlier data sample are reliably eliminated from the to-be-processed actual data, so that the finally updated average of the to-be-processed actual data is closer to the center of the normal data distribution. This permits extraction of only highly reliable normal data samples, so that the operation amount-throttle opening degree characteristic is more properly determined.

The marine vessel running controlling apparatus preferably further includes a difference judging unit arranged to judge whether a difference between pre-update control information and post-update control information is less than a predetermined threshold, and an update suspending unit arranged to suspend the update of the control information if it is judged that the difference is not less than the threshold. With this unique arrangement, the update of the control information is suspended if the difference between the pre-update control information and the post-update control information is significant. This suppresses an unnatural feeling which may otherwise occur in the operator due to a significant change in the marine vessel maneuvering characteristic. The marine vessel running controlling apparatus may be arranged such that, if the difference in control information is significant, for example, the updated control information is adopted on approval by the operator.

The marine vessel running controlling apparatus may further include a data sample number judging unit arranged to judge whether the number of the normal data samples satisfies a predetermined number requirement. In this case, the control unit is preferably arranged to update the control information if the data sample number judging unit judges that the number requirement is satisfied. With this unique arrangement, the control information is not updated until a sufficient number of normal data samples are collected. Therefore, the updated control information is highly reliable.

The marine vessel running controlling apparatus preferably further includes an update notifying unit arranged to notify the operator that the control information has been updated. If there is a possibility that the marine vessel maneuvering characteristic is changed due to the update of the control information, the operator is notified of the possibility. This alleviates the unnatural feeling occurring in the operator due to the change in the characteristic.

Another preferred embodiment of the present invention provides a marine vessel which includes a hull, a propulsive force generating unit attached to the hull and including an engine with an electric throttle as a drive source for generating a propulsive force, and the marine vessel running controlling apparatus described above. With this unique arrangement, the marine vessel has an improved maneuvering characteristic.

The marine vessel may be a relatively small-scale marine vessel such as a cruiser, a fishing boat, a water jet or a watercraft, or any other suitable marine or non-marine vessel or vehicle.

The propulsive force generating unit may be in the form of an outboard motor, an inboard/outboard motor (a stern drive or an inboard motor/outboard drive), an inboard motor, a water jet drive, or other suitable motor or drive. The outboard motor preferably includes a propulsion unit provided outboard of the vessel and having a motor (engine) and a propulsive force generating member (propeller), and a steering mechanism which horizontally turns the entire propulsion unit with respect to the hull. The inboard/outboard motor preferably includes a motor provided inboard of the vessel, and a drive unit provided outboard and having a propulsive force generating member and a steering mechanism. The inboard motor preferably includes a motor and a drive unit provided inboard, and a propeller shaft extending outboard from the drive unit. In this case, a steering mechanism is preferably separately provided. The water jet drive is preferably arranged such that water sucked from the bottom of the marine vessel is accelerated by a pump and ejected from an ejection nozzle provided at the stern of the marine vessel to provide a propulsive force. In this case, the steering mechanism preferably includes the ejection nozzle and a mechanism for turning the ejection nozzle in a horizontal plane.

Other elements, features, steps, characteristics and advantages of the present invention will become more apparent from the following detailed description of the preferred embodiments with reference to the attached drawings.

DETAILED DESCRIPTION OF PREFERRED EMBODIMENTS

Figure 1:
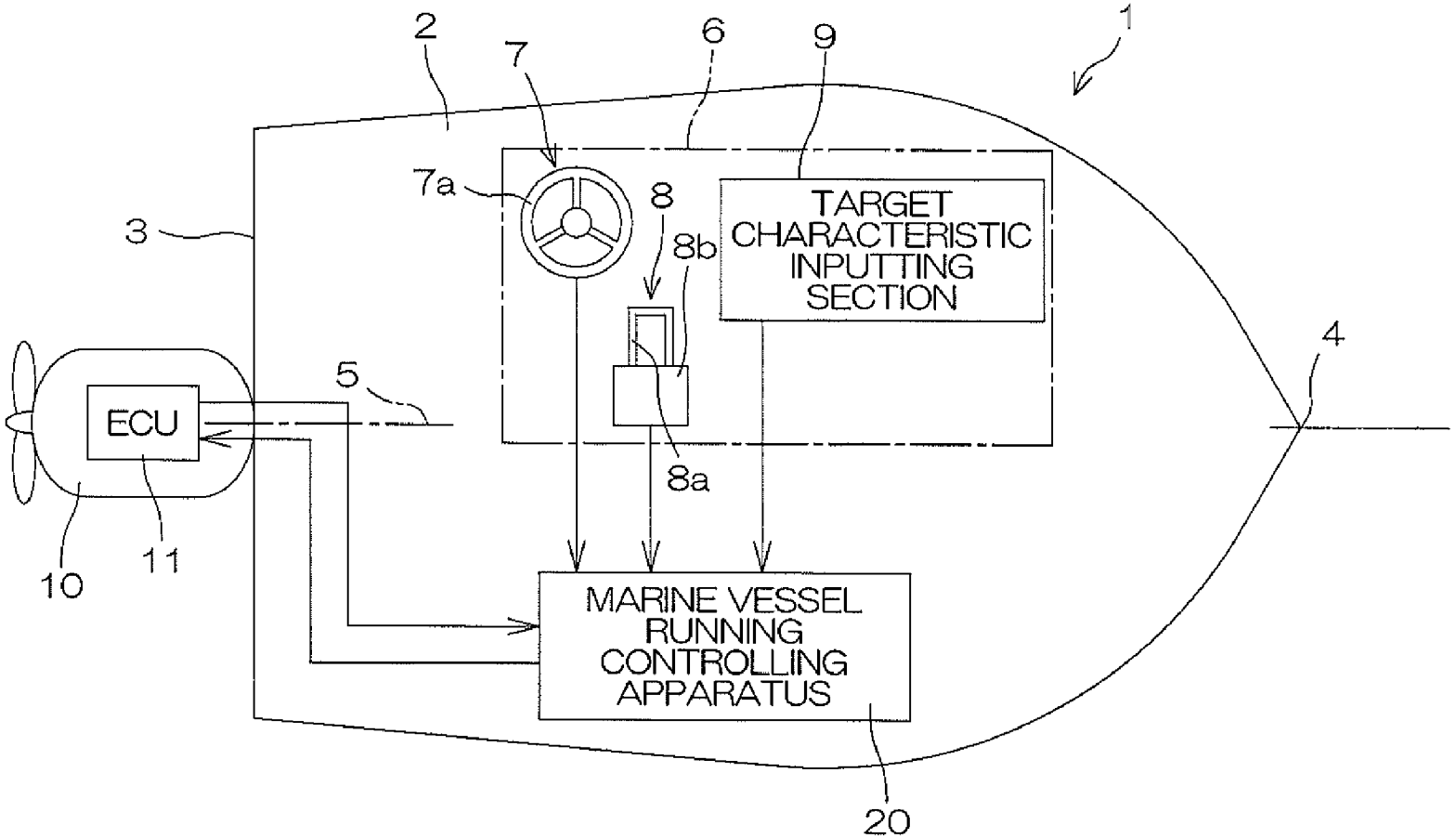
FIG. 1 is a schematic diagram for explaining the construction of a marine vessel according to one preferred embodiment of the present invention.

FIG. 1 is a schematic diagram for explaining the construction of a marine vessel 1 according to one preferred embodiment of the present invention. The marine vessel 1 is preferably a relatively small-scale marine vessel, such as a cruiser or a boat. The marine vessel 1 includes a hull 2, and an outboard motor 10 (propulsive force generating unit) attached to a stern (transom) 3 of the hull 2. The outboard motor 10 is positioned on a center line 5 of the hull 2 extending through the stern 3 and a bow 4 of the hull 2. An electronic control unit 11 (hereinafter referred to as "outboard motor ECU 11") is incorporated in the outboard motor 10.

A control console 6 for controlling the marine vessel 1 is provided on the hull 2. The control console 6 includes, for example, a steering operational section 7 for performing a steering operation, a throttle operational section 8 for controlling the output of the outboard motor 10, and a target characteristic inputting section 9 (a target characteristic inputting unit and a target characteristic change inputting unit). The steering operational section 7 includes a steering wheel 7*a* as a steering operational member. The throttle operational section 8 includes a remote control lever (throttle lever) 8*a* as a throttle operational member (operational unit), and a lever position detecting section 8*b* such as a potentiometer for detecting the operation position of the remote control lever 8*a*. The target characteristic inputting section 9 inputs a target characteristic for a remote control opening degree-engine speed characteristic which defines a relationship between the operation amount (remote control opening degree) of the remote control lever 8*a* and the engine speed of the outboard motor 10.

Input signals indicating the operation amounts of the operational sections 7, 8 provided on the control console 6 and an input signal from the target characteristic inputting section 9 are input as electric signals to a marine vessel running controlling apparatus 20. These electric signals are transmitted to the marine vessel running controlling apparatus 20 from the control console 6, for example, preferably via a LAN (local area network, hereinafter referred to as "inboard LAN") provided in the hull 2, although other signal transmission methods such as wireless transmission may be used. The marine vessel running controlling apparatus 20 is an electronic control unit (ECU) including a microcomputer, and functions as a propulsive force controlling apparatus for propulsive force control and as a steering controlling apparatus for steering control.

The marine vessel running controlling apparatus 20 communicates with the outboard motor ECU 11 preferably via the inboard LAN. More specifically, the marine vessel running controlling apparatus 20 acquires the engine speed (rpm) of the outboard motor 10, a steering angle indicating the orientation of the outboard motor 10, an engine throttle opening degree, and the shift position of the outboard motor 10 (forward drive, neutral, or reverse drive position) from the outboard motor ECU 11. The marine vessel running controlling apparatus 20 applies data including a target steering angle, a target throttle opening degree, a target shift position (forward drive, neutral, or reverse drive position) and a target trim angle to the outboard motor ECU 11.

The marine vessel running controlling apparatus 20 controls the steering angle of the outboard motor 10 according to the operation of the steering wheel 7*a*. The marine vessel running controlling apparatus 20 determines the target throttle opening degree and the target shift position for the outboard motor 10 according to the operation amount and direction of the remote control lever 8*a* (i.e., a lever position). The remote control lever 8*a* can be inclined forward and reverse. When an operator inclines the remote control lever 8*a* forward from a neutral position by a certain amount, the marine vessel running controlling apparatus 20 sets the target shift position of the outboard motor 10 at the forward drive position. When the operator inclines the remote control lever 8*a* further forward, the marine vessel running controlling apparatus 20 sets the target throttle opening degree of the outboard motor 10 according to the operation amount of the remote control lever 8*a*. On the other hand, when the operator inclines the remote control lever 8*a* reverse by a certain amount, the marine vessel running controlling apparatus 20 sets the target shift position of the outboard motor 10 at the reverse drive position. When the operator inclines the remote control lever 8*a* further reverse, the marine vessel running controlling apparatus 20 sets the target throttle opening degree of the outboard motor 10 according to the operation amount of the remote control lever 8*a*.

Figure 2:
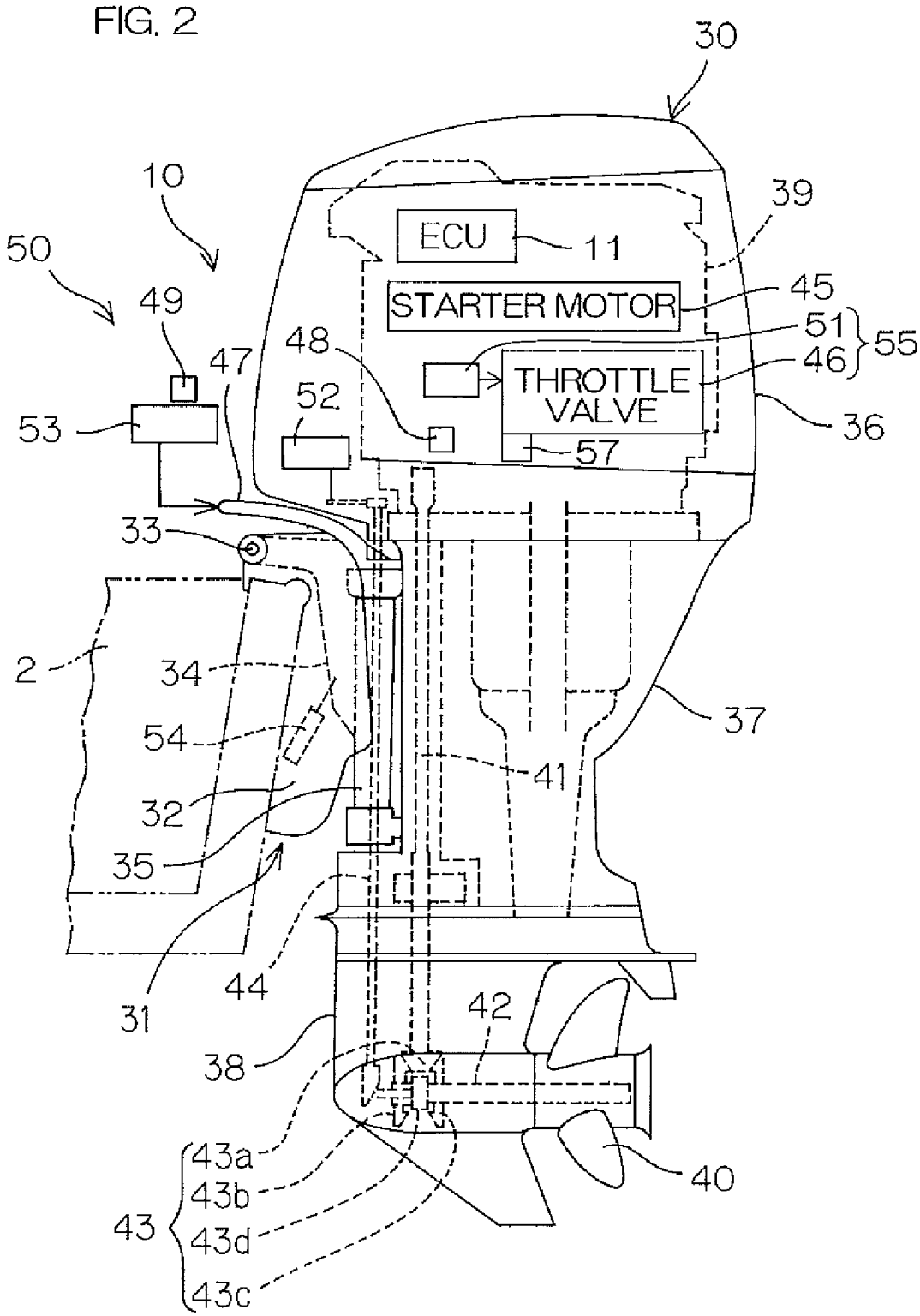
FIG. 2 is a schematic sectional view for explaining the construction of an outboard motor.

FIG. 2 is a schematic sectional view for explaining the construction of the outboard motor 10. The outboard motor 10 includes a propulsion unit 30 (propulsion system) and an attachment mechanism 31 for attaching the propulsion unit 30 to the hull 2. The attachment mechanism 31 includes a clamp bracket 32 detachably fixed to the transom of the hull 2, and a swivel bracket 34 connected to the clamp bracket 32 pivotally about a tilt shaft 33 (horizontal pivot axis). The propulsion unit 30 is attached to the swivel bracket 34 pivotally about a steering shaft 35. Thus, the steering angle (which is equivalent to an angle defined by the direction of the propulsive force with respect to the center line 5 of the hull 2) is changed by pivoting the propulsion unit 30 about the steering shaft 35. Further, the trim angle of the propulsion unit 30 (which is equivalent to an angle defined by the direction of the propulsive force with respect to a horizontal plane) is changed by pivoting the swivel bracket 34 about the tilt shaft 33.

The propulsion unit 30 has a housing which includes a top cowling 36, an upper case 37, and a lower case 38. An engine 39 is provided as a drive source in the top cowling 36 with an axis of a crank shaft thereof extending vertically. A drive shaft 41 for power transmission is coupled to a lower end of the crank shaft of the engine 39, and vertically extends through the upper case 37 into the lower case 38.

A propeller 40 (propulsive force generating member) is rotatably attached to a lower rear portion of the lower case 38. A propeller shaft 42 (rotation shaft) of the propeller 40 extends horizontally in the lower case 38. The rotation of the drive shaft 41 is transmitted to the propeller shaft 42 via a shift mechanism 43 (clutch mechanism).

The shift mechanism 43 includes a beveled drive gear 43*a* fixed to a lower end of the drive shaft 41, a beveled forward drive gear 43*b* rotatably provided on the propeller shaft 42, a beveled reverse drive gear 43*c* rotatably provided on the propeller shaft 42, and a dog clutch 43*d* provided between the forward drive gear 43*b* and the reverse drive gear 43*c*.

The forward drive gear 43*b* is meshed with the drive gear 43*a* from a forward side, and the reverse drive gear 43*c* is meshed with the drive gear 43*a* from a reverse side. Therefore, the forward drive gear 43*b* and the reverse drive gear 43*c* rotate in opposite directions when engaged with the drive gear 43*a*.

On the other hand, the dog clutch 43*d* is in spline engagement with the propeller shaft 42. That is, the dog clutch 43*d* is axially slidable with respect to the propeller shaft 42, but is not rotatable relative to the propeller shaft 42. Therefore, the dog clutch 43*d* is rotatable together with the propeller shaft 42.

The dog clutch 43*d* is slidable on the propeller shaft 42 by pivotal movement of a shift rod 44 that extends vertically parallel to the drive shaft 41 and is rotatable about its axis. Thus, the shift position of the dog clutch 43*d* is controlled to be set at a forward drive position at which it is engaged with the forward drive gear 43*b*, at a reverse drive position at which it is engaged with the reverse drive gear 43*c*, or at a neutral position at which it is not engaged with either the forward drive gear 43*b* or the reverse drive gear 43*c*.

When the dog clutch 43*d* is in the forward drive position, the rotation of the forward drive gear 43*b* is transmitted to the propeller shaft 42 via the dog clutch 43*d* with virtually no slippage between the dog clutch 43*d* and the propeller shaft 42. Thus, the propeller 40 is rotated in one direction (in a forward drive direction) to generate a propulsive force in a direction for moving the hull 2 forward. On the other hand, when the dog clutch 43*d* is in the reverse drive position, the rotation of the reverse drive gear 43*c* is transmitted to the propeller shaft 42 via the dog clutch 43*d* with virtually no slippage between the dog clutch 43*d* and the propeller shaft 42. The reverse drive gear 43*c* is rotated in a direction opposite to that of the forward drive gear 43*b*. Therefore, the propeller 40 is rotated in an opposite direction (in a reverse drive direction) to generate a propulsive force in a direction for moving the hull 2 in reverse. When the dog clutch 43*d* is in the neutral position, the rotation of the drive shaft 41 is not transmitted to the propeller shaft 42. That is, transmission of a driving force between the engine 39 and the propeller 40 is prevented, so that no propulsive force is generated in either of the forward and reverse directions.

Without a speed change gear in the outboard motor 10, the propeller 40 is rotated according to the rotational speed of the engine 39 when the dog clutch 43*d* is in the forward drive position or the reverse drive position.

A starter motor 45 for starting the engine 39 is connected to the engine 39. The starter motor 45 is controlled by the outboard motor ECU 11. The propulsion unit 30 further includes a throttle actuator 51 for actuating a throttle valve 46 of the engine 39 in order to change the throttle opening degree to change the intake air amount of the engine 39. The throttle actuator 51 may be an electric motor. The throttle actuator 51 and the throttle valve 46 define an electric throttle 55.

The operation of the throttle actuator 51 is controlled by the outboard motor ECU 11. The opening degree of the throttle valve 46 (throttle opening degree) is detected by a throttle opening degree sensor 57, and an output of the throttle opening degree sensor 57 is applied to the outboard motor ECU 11. The engine 39 further includes an engine speed detecting section 48 for detecting the rotation of the crank shaft to detect the rotational speed N of the engine 39.

A shift actuator 52 (clutch actuator) for changing the shift position of the dog clutch 43*d* is provided in relation to the shift rod 44. The shift actuator 52 is, for example, an electric motor, and its operation is controlled by the outboard motor ECU 11.

Further, a steering actuator 53 which includes, for example, a hydraulic cylinder and is controlled by the outboard motor ECU 11 is connected to a steering rod 47 fixed to the propulsion unit 30. By driving the steering actuator 53, the propulsion unit 30 is pivoted about the steering shaft 35 for the steering operation. The steering actuator 53, the steering rod 47 and the steering shaft 35 define a steering mechanism 50. The steering mechanism 50 includes a steering angle sensor 49 for detecting the steering angle.

A trim actuator (tilt trim actuator) 54 which includes, for example, a hydraulic cylinder and is controlled by the outboard motor ECU 11, is provided between the clamp bracket 32 and the swivel bracket 34. The trim actuator 54 pivots the propulsion unit 30 about the tilt shaft 33 by pivoting the swivel bracket 34 about the tilt shaft 33. Thus, the trim angle of the propulsion unit 30 is changed.

Figure 3:
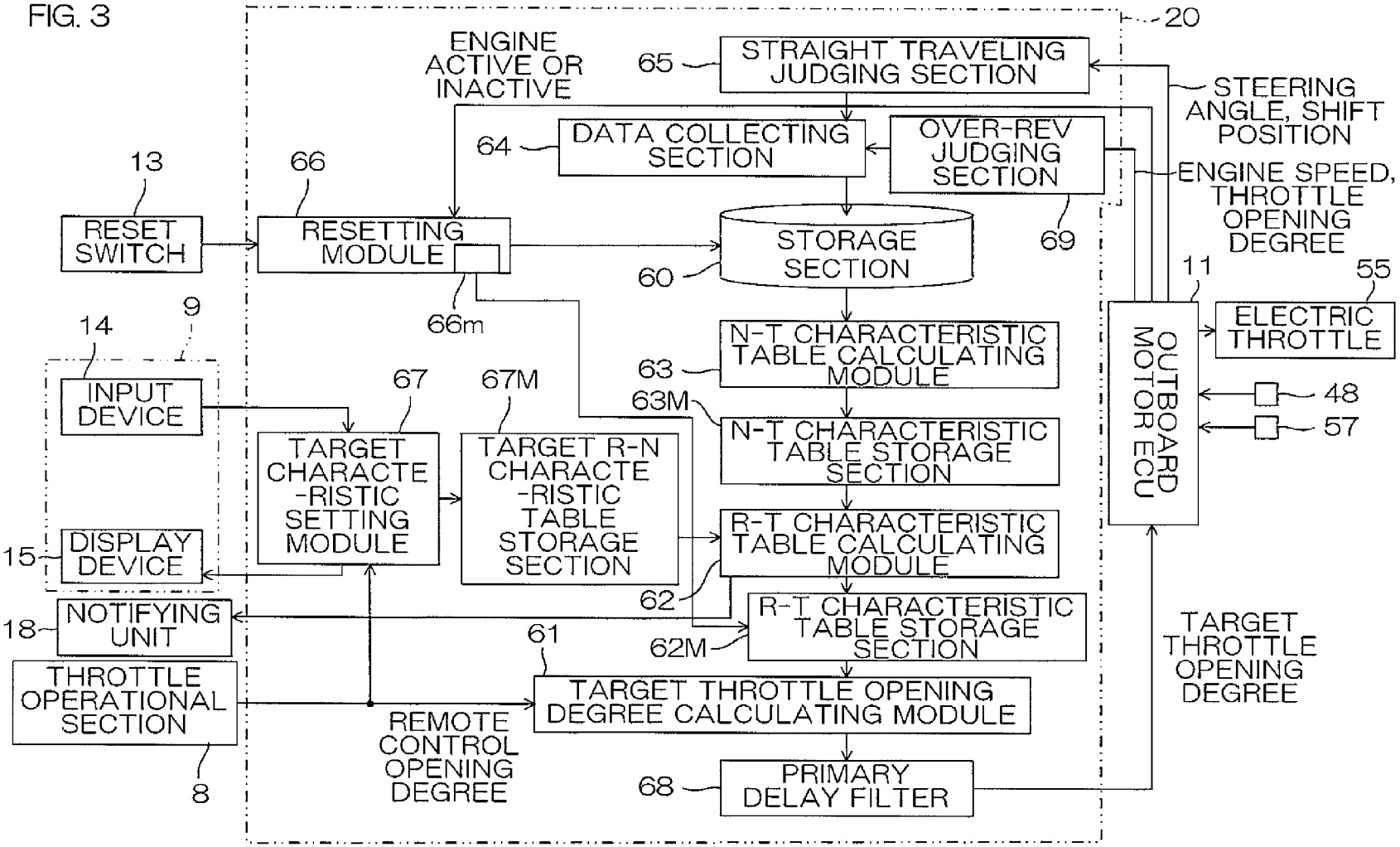
FIG. 3 is a block diagram for explaining an arrangement for controlling an electric throttle.

FIG. 3 is a block diagram for explaining an arrangement for controlling the electric throttle 55. The marine vessel running controlling apparatus 20 preferably includes a microcomputer including a CPU (central processing unit) and a memory, and performs predetermined software-based processes to function virtually as a plurality of functional sections (control unit). More specifically, the marine vessel running controlling apparatus 20 includes, as the functional sections, a target throttle opening degree calculating module 61 (target throttle opening degree setting unit), an R-T characteristic table calculating module 62 (throttle opening degree characteristic setting unit), an N-T characteristic table calculating module 63, a data collecting section 64 (an actual data eliminating unit and an actual data acquisition prohibiting unit), a straight traveling judging section 65 (straight traveling judging unit), and an over-rev judging section 69 (abnormal drive judging unit).

The target throttle opening degree calculating module 61 calculates a target throttle opening degree as a target value of the opening degree of the throttle valve 46 (throttle opening degree) according to the operation amount of the remote control lever 8*a* (hereinafter referred to as "remote control opening degree") detected by the lever position detecting section 8*b* of the throttle operational section 8. The R-T characteristic table calculating module 62 calculates a remote control opening degree-target throttle opening degree characteristic (hereinafter referred to as "R-T characteristic") indicating a target throttle opening degree characteristic with respect to the remote control opening degree. The N-T characteristic table calculating module 63 calculates an engine speed-throttle opening degree characteristic (hereinafter referred to as "N-T characteristic") indicating an actual throttle opening degree characteristic with respect to the engine speed. The data collecting section 64 collects actual data of the engine speed and the throttle opening degree obtained from the outboard motor ECU 11 during travel of the marine vessel for the calculation of the N-T characteristic. The straight traveling judging section 65 receives data of the steering angle and the shift position from the outboard motor ECU 11, and judges whether the marine vessel 1 is in a straight traveling state. The over-rev judging section 69 receives data of the engine speed, and judges whether the engine 39 is in an over-rev state.

The over-rev judging section 69 judges that the engine 39 is in the over-rev state, for example, when the engine speed is abruptly increased to a predetermined threshold (e.g., about 6,500 rpm) due to free rotation of the propeller 40. The over-rev judging section 69 may have the function of temporarily interrupting the ignition of a fuel/air mixture in the engine 39 or fuel supply to the engine 39 in addition to the engine over-rev judging function. Thus, the over-rev of the engine 39 is quickly eliminated, thereby preventing the jump of a valve spring and other inconveniences which may otherwise occur due to the over-rev of the engine 39. If the engine speed is reduced to a level less than the threshold and kept in this state for a predetermined period (e.g., about 10 seconds), the over-rev judging section 69 judges that the engine 39 has recovered from the over-rev state (the engine 39 is not in the over-rev state).

A storage section 60 for storing the actual data of the engine speed and the throttle opening degree collected by the data collecting section 64 as learning data is provided in the memory of the marine vessel running controlling apparatus 20. The marine vessel running controlling apparatus 20 further includes, as the functional sections, a resetting module 66, a target characteristic setting module 67 (a target characteristic setting unit and a target characteristic curve updating unit), and a primary delay filter 68. The resetting module 66 resets the learning data stored in the storage section 60. The target characteristic setting module 67 determines a target characteristic for a remote control opening degree-engine speed characteristic (hereinafter referred to as "R-N characteristic") indicating an engine speed characteristic with respect to the remote control opening degree. The primary delay filter 68 minimizes a sudden change in an engine output occurring due to a sudden change in the throttle opening degree when the R-T characteristic is changed. In this preferred embodiment, the data collecting section 64, the N-T characteristic table calculating module 63 and the like define an engine characteristic measuring unit.

The memory of the marine vessel running controlling apparatus 20 includes the aforementioned storage section 60 as well as an R-T characteristic table storage section 62M (throttle opening degree characteristic storage unit) which stores an R-T characteristic table (control information related to the opening degree of the electric throttle), an N-T characteristic table storage section 63M (engine characteristic storage unit) which stores an N-T characteristic table, and a target R-N characteristic table storage section 67M (target characteristic storage unit) which stores a target R-N characteristic table. The N-T characteristic table calculating module 63 stores a calculated N-T characteristic table in the N-T characteristic table storage section 63M. Further, the target characteristic setting module 67 stores a target R-N characteristic table in the R-N characteristic table storage section 67M. The R-T characteristic table calculating module 62 calculates an R-T characteristic table based on the N-T characteristic table stored in the N-T characteristic table storage section 63M and the target R-N characteristic table stored in the target R-N characteristic table storage section 67M, and stores the calculated R-T characteristic table in the R-T characteristic table storage section 62M. Further, the target throttle opening degree calculating module 61 calculates the target throttle opening degree for the remote control opening degree based on the R-T characteristic table stored in the R-T characteristic table storage section 62M.

At least the storage section 60, the R-T characteristic table storage section 62M and the R-N characteristic table storage section 67M, for example, are preferably nonvolatile storage media. An R-T characteristic table defining a linear relationship between the remote control opening degree and the target throttle opening degree, for example, may be initially stored in the R-T characteristic table storage section 62M. Further, a target R-N characteristic table defining a linear relationship between the remote control opening degree and the target engine speed, for example, may be initially stored in the R-N characteristic table storage section 67M.

Although not shown in FIG. 1, a reset switch 13 for applying a reset signal to the resetting module 66 and a notifying unit 18 (update notifying unit) for notifying the operator that the marine vessel maneuvering characteristic has been changed are preferably provided on the control console 6. The notifying unit 18 may be a lamp such as an LED, or a sound generating device (e.g., a buzzer or a speaker) which generates an alarm or an audible notification message. The target characteristic inputting section 9 provided on the control console 6 provides a man-machine interface for the target characteristic setting module 67, and includes an input device 14 and a display device 15. The display device 15 is preferably a two-dimensional display device such as a liquid crystal display panel or a CRT. The display device 15 may double as the notifying unit 18. Further, the input device 14 may include, for example, a pointing device (e.g., a mouse, a track ball, or a touch panel) for performing an inputting operation on a target characteristic curve displayed on the display device 15, a key inputting section and the like.

The straight traveling judging section 65 judges whether the marine vessel 1 is in the straight traveling state, when the outboard motor 10 is driven to run the marine vessel 1. More specifically, if the shift position of the outboard motor 10 is set at the forward drive position or at the reverse drive position and the steering angle falls within a predetermined neutral range (e.g., a range defined between a position spaced about 5 degrees from a neutral position to a port side and a position spaced about 5 degrees from the neutral position to a starboard side), the straight traveling judging section 65 judges that the marine vessel 1 is in the straight traveling state.

The data collecting section 64 collects the actual data of the engine speed and the throttle opening degree from the outboard motor ECU 11 in a period during which the straight traveling judging section 65 continuously judges that the marine vessel 1 is in the straight traveling state. More specifically, the data collecting section 64 receives an actual data pair of the engine speed detected by the engine speed detecting section 48 and the throttle opening degree detected by the throttle opening degree sensor 57 from the outboard motor ECU 11 in a predetermined cycle, and stores the actual data pair of the engine speed and the throttle opening degree as the learning data in the storage section 60.

If the over-rev judging section 69 judges that the engine 39 is in the over-rev state, the data collecting section 64 stops collecting the actual data. If the over-rev judging section 69 thereafter judges that the engine 39 has recovered from the over-rev state, the data collecting section 64 resumes collecting the actual data. Therefore, actual data obtained when the engine 39 is in the over-rev state is eliminated. Thus, the data collecting section 64 collects only the actual data obtained when the engine 39 is out of the over-rev state, and stores the collected actual data in the storage section 60.

The N-T characteristic table calculating module 63 calculates the N-T characteristic table based on the learning data stored in the storage section 60. The R-T characteristic table calculating module 62 calculates the R-T characteristic table based on the N-T characteristic table calculated by the N-T characteristic table calculating module 63 and the target R-N characteristic set by the target characteristic setting module 67. The target throttle opening degree calculating module 61 calculates the target throttle opening degree according to the R-T characteristic table. By driving the electric throttle 55 of the outboard motor 10 with the target throttle opening degree thus calculated, the relationship between the remote control opening degree and the engine speed conforms to the target R-N characteristic.

It is herein assumed, for example, that a linear target R-N characteristic is set by the target characteristic setting module 67 when the N-T characteristic calculated based on the learning data collected and stored in the storage section 60 by the data collecting section 64 is nonlinear. In this case, the R-T characteristic table calculating module 62 sets a nonlinear R-T characteristic. That is, the target throttle opening degree is nonlinearly changed with respect to the remote control opening degree. The engine speed is nonlinearly changed with respect to the throttle opening degree, so that the engine speed is linearly changed with respect to the remote control opening degree.

The R-T characteristic is thus set based on the N-T characteristic determined based on the actual data obtained during the actual travel of the marine vessel. Therefore, the actual data is reflected to the R-T characteristic. The target throttle opening degree is set according to the R-T characteristic, and the electric throttle 55 is driven with the target throttle opening degree thus set, whereby the R-N characteristic can be adapted for the operator's preference. For example, the relationship between the operation amount of the remote control lever 8*a* and the engine output is set to be linear. Thus, the engine output can be easily set at an intended level by operating the remote control lever 8*a* in an intuitive manner. Thus, even an unskilled operator can properly control the engine output for a desired marine vessel maneuvering operation. For example, the operator can easily perform the marine vessel maneuvering operation by finely controlling the throttle in a lower engine output state for moving the marine vessel toward or away from a docking site or for trolling. In a higher engine output state, the engine output can be changed with higher responsiveness to the operation of the remote control lever 8*a*.

The resetting module 66 preferably includes a nonvolatile memory 66*m* which stores a standard R-T characteristic table. The standard R-T characteristic table defines, for example, a linear R-T characteristic. When the reset switch 13 is operated, the resetting module 66 resets (erases) the learning data in the storage section 60, and reads the standard R-T characteristic table from the nonvolatile memory 66*m* and writes the standard R-T characteristic table in the R-T characteristic table storage section 62M. Thus, a reset operation is performed to reset the R-T characteristic to the standard R-T characteristic.

Engine operation status data indicating whether the engine 39 is in an active state or in an inactive state, for example, is applied to the resetting module 66 from the outboard motor ECU 11. Only when the engine 39 is in the inactive state, the resetting module 66 performs the reset operation upon reception of the reset signal input from the reset switch 13. If the engine 39 is in the active state, the resetting module 66 nullifies the input from the reset switch 13, and does not perform the reset operation.

The remote control opening degree is herein determined by AD-converting the detected position of the remote control lever 8*a*, and expressed on a scale from 0% to 100%. Similarly, the throttle opening degree is expressed on a scale from 0% to 100%. However, how to express the remote control opening degree and the throttle opening degree is not limited to the aforesaid expression.

Figure 4:
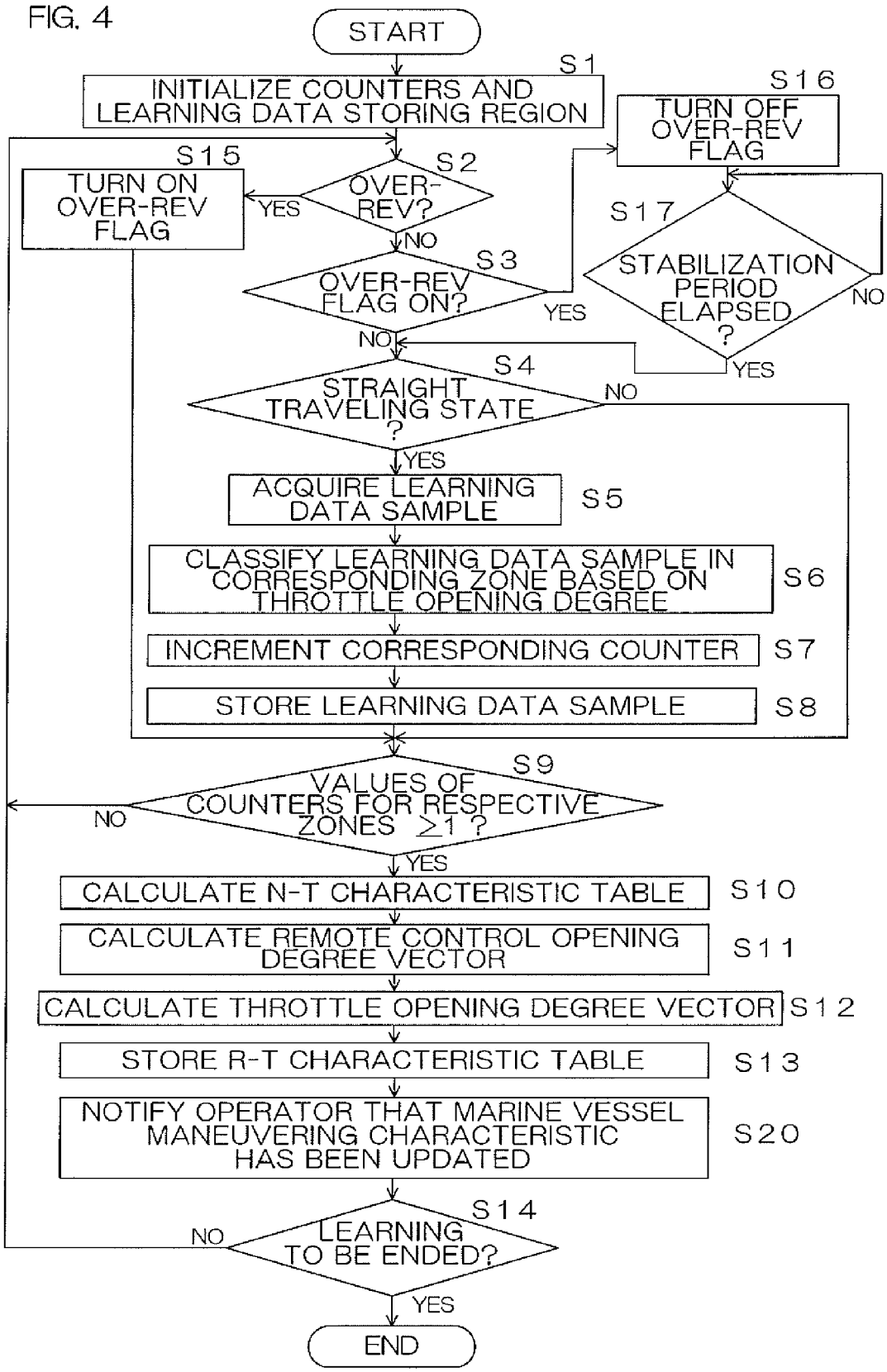
FIG. 4 is a flow chart for explaining the operation of a marine vessel running controlling apparatus.

FIG. 4 is a flow chart for explaining the operation of the marine vessel running controlling apparatus 20. The data collecting section 64 divides a throttle opening degree range into m zones $M_1, M_2, \ldots, M_m$ (wherein m is a natural number not smaller than 2). Then, counters $c_i$ (i=1, . . . , m) which respectively count the numbers of data samples (ϕ, N) of the learning data classified into the zones $M_i$ and a learning data storing region which stores the data samples (ϕ, N) of the learning data are defined in the storage section 60, and initialized by the data collecting section 64 (Step S1). The data samples (ϕ, N) of the learning data each include a data pair of the throttle opening degree ϕ and the engine speed N.

Figure 5:
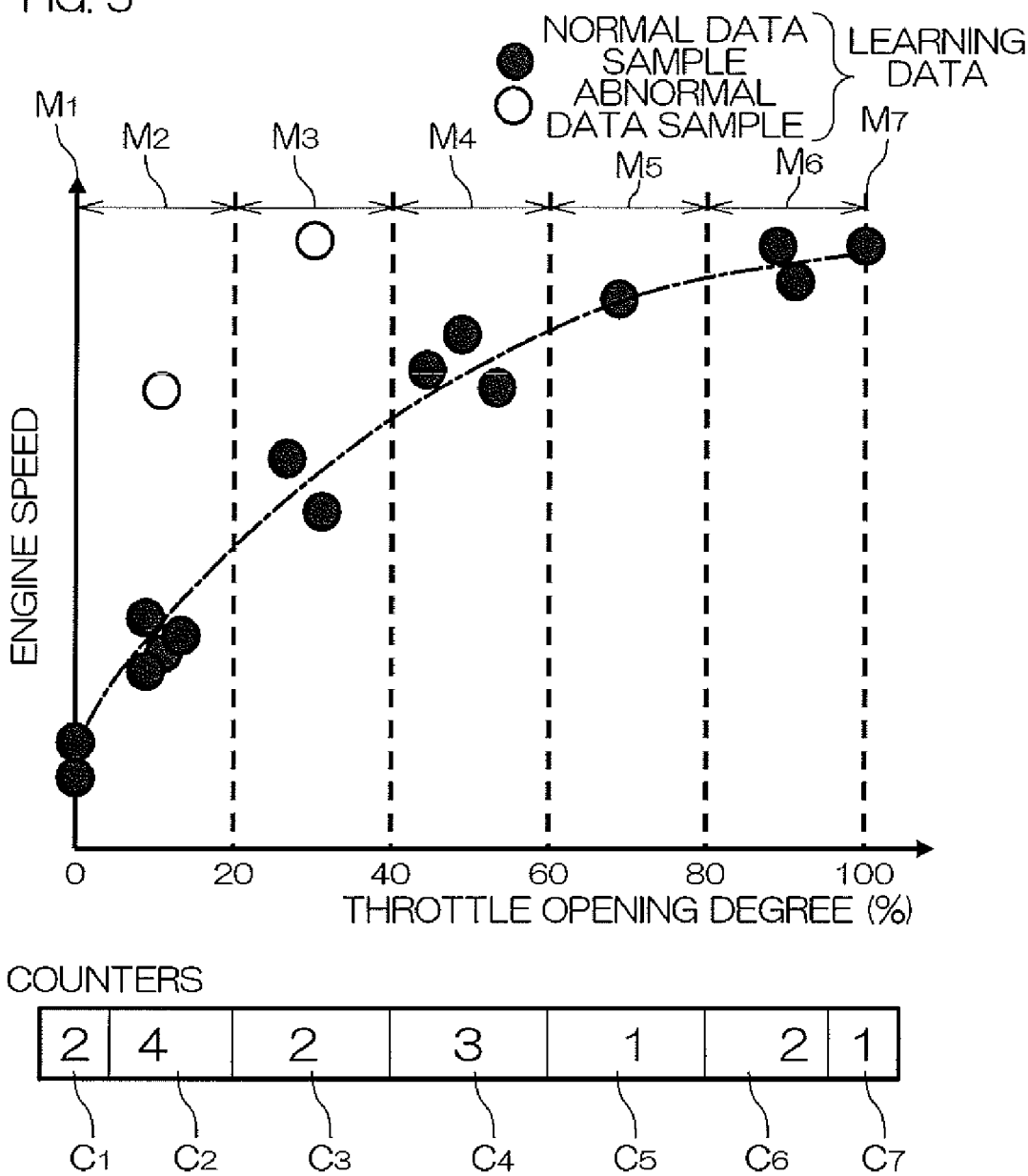
FIG. 5 is a diagram for explaining measurement of an engine speed-throttle opening degree characteristic.

With reference to FIG. 5, the zones $M_1$ and the counters $c_i$ will be described by way of example. In this example, the throttle opening degree ϕ is expressed on a scale from 0% (fully closed state) to 100% (fully open state). In this example, the throttle opening degree range (0% to 100%) is divided into the following seven zones $M_1$ to $M_7$: a first zone $M_1$ of $\phi \leqq 0$; a second zone $M_2$ of $0<\phi \leqq 20$; a third zone $M_3$ of $20<\phi \leqq 40$; a fourth zone $M_4$ of $40<\phi \leqq 60$; a fifth zone $M_5$ of $60<\phi \leqq 80$; a sixth zone $M_6$ of $80<\phi<100$; and a seventh zone $M_7$ of $\phi \geqq 100$. The counters $c_1$ to $c_7$ are provided in a one-to-one correspondence with the first to seventh zones $M_1$ to $M_7$.

Referring back to FIG. 4, the data collecting section 64 judges whether the engine 39 is in the over-rev state as judged by the over-rev judging section 69 (Step S2). If the engine 39 is not in the over-rev state as judged by the over-rev judging section 69 (NO in Step S2), the data collecting section 64 further judges whether an over-rev flag is in an ON state (Step S3). The ON state of the over-rev flag means that the preceding state of the engine 39 is the over-rev state. In contrast, an OFF state of the over-rev flag means that the preceding state of the engine 39 is not the over-rev state (the preceding state of the engine 39 is a normal drive state).

If the over-rev flag is in the OFF state (NO in Step S3), the data collecting section 64 judges whether the marine vessel 1 is in the straight traveling state as judged by the straight traveling judging section 65 (Step S4). If the marine vessel 1 is in the straight traveling state (YES in Step S4), the data collecting section 64 acquires an actual data sample including the throttle opening degree ϕ and the engine speed N from the outboard motor ECU 11 (Step S5). The data collecting section 64 classifies the acquired actual data sample into a corresponding one of the zones $M_i$ based on the throttle opening degree (Step S6). Then, the data collecting section 64 increments the counter $c_i$ for that zone $M_i$ (Step S7), and stores the actual data sample in the storage section 60 (Step S8).

Of the actual data samples (learning data) stored in the storage section 60, data samples obtained when the engine 39 is in the normal drive state (hereinafter referred to as "normal data samples") are each indicated by a black circle in FIG. 5. Further, data samples obtained when the engine 39 is in the over-rev state (hereinafter referred to as "abnormal data samples") are each indicated by a white circle in FIG. 5 for reference. The normal data samples roughly conform to a single approximation curve (as indicated by a one-dot-and-dash line in FIG. 5). On the other hand, the abnormal data samples each having an excessively high engine speed because of the over-rev of the engine 39 are significantly deviated upward from the approximation curve (to a higher speed side).

Referring back to FIG. 4, the N-T characteristic table calculating module 63 judges whether the counters $c_1$ to $c_7$ for the respective zones each have a value not smaller than a predetermined lower limit value (in this preferred embodiment, "1" which is an exemplary data number requirement), functioning as a data number judging unit (Step S9). If the counters $c_1$ to $c_7$ for the respective zones each have a value not smaller than the predetermined lower limit value, the N-T characteristic table calculating module 63 performs an N-T characteristic table calculating operation (Step S10). If not all the values of the counters $c_1$ to $c_7$ reach the lower limit value, the N-T characteristic table calculating module 63 judges that the learning data is insufficient, and does not perform the N-T characteristic table calculating operation. In this case, a process sequence from Step S2 is repeated.

More specifically, if the counters $c_i$ for the respective zones each have a value not smaller than the lower limit value "1", the N-T characteristic table calculating module 63 calculates representative data for each of the zones $M_i$ based on the data samples of the learning data classified in the zone $M_i$. For example, the N-T characteristic table calculating module 63 calculates the representative data from the following expression (1):

$$\overline{\phi}_i = \frac{1}{c_i}\sum_{j=1}^{c_i}\phi_{ij},\ \overline{N}_i = \frac{1}{c_i}\sum_{j=1}^{c_i}N_{ij},\ i = 1, 2, \ldots, m \tag{1}$$

wherein ϕ and N each affixed with an upper line are defined as averages. In this manner, engine speed averages $N_i$ and throttle opening degree averages $\phi_i$ are determined as the representative data for the respective zones $M_i$.

Thus, a data pair [N, ϕ] including an m-dimensional average engine speed vector $N=[N_1, N_2, \ldots, N_m]$ (as an exemplary engine speed representative value vector) and an m-dimensional average throttle opening degree vector $\phi=[\phi_1, \phi_2, \ldots, \phi_m]$ (as an exemplary throttle opening degree representative value vector) is provided. The data pair of the engine speed representative value vector and the throttle opening degree representative value vector is an N-T characteristic table.

Figure 6:
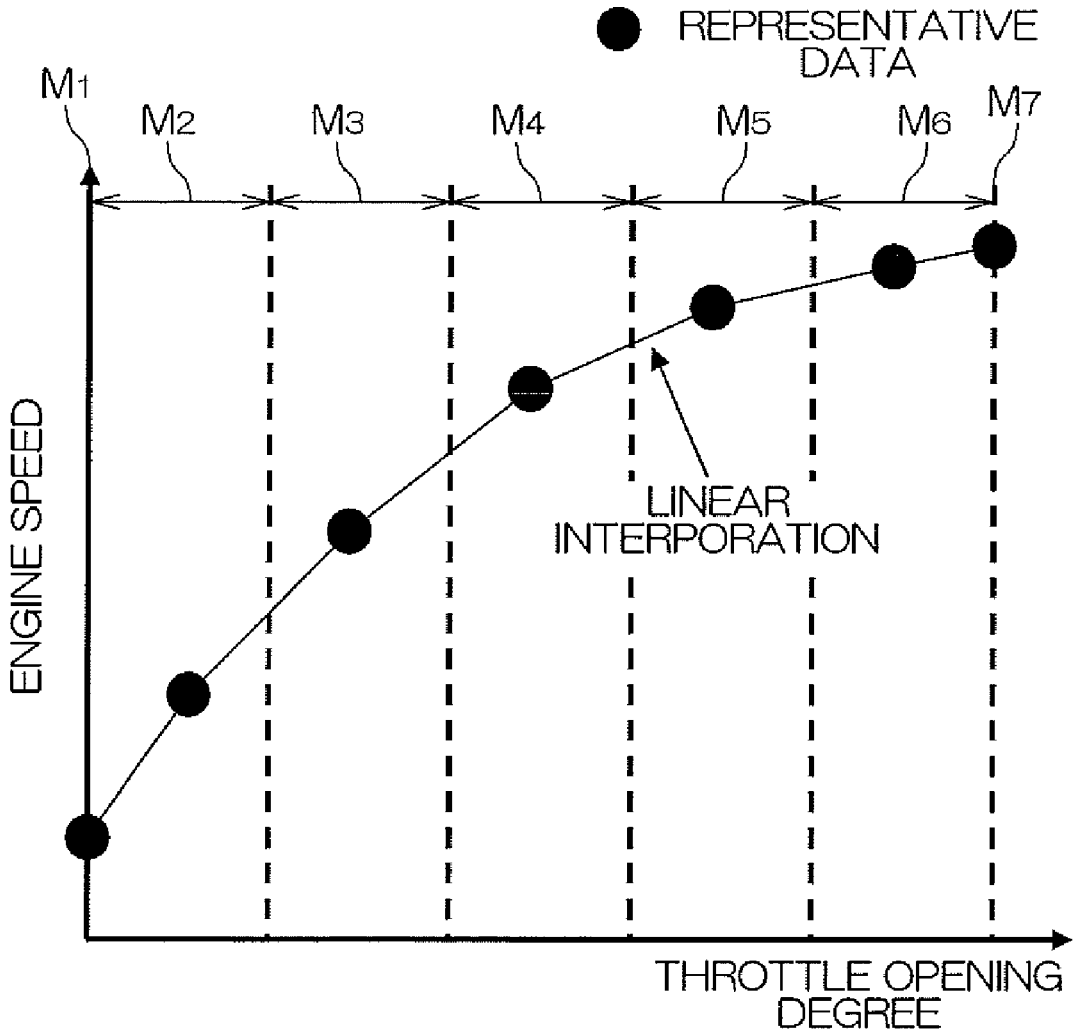
FIG. 6 is a diagram for explaining calculation of the engine speed-throttle opening degree characteristic by way of example.

As shown in FIG. 6, the N-T characteristic table defines a relationship between the engine speed and the throttle opening degree. The N-T characteristic table shown in FIG. 6 is provided for an ordinary engine by way of example. That is, the engine speed steeply increases with an increase in the throttle opening degree in a lower throttle opening degree range, and moderately increases with the increase in the throttle opening degree in a higher throttle opening degree range. The N-T characteristic table includes a finite number of discrete data plots (indicated by black circles in FIG. 6) each defined by an engine speed representative value and a throttle opening degree representative value. As required, characteristic data between the discrete data plots is estimated by linear interpolation.

On the other hand, the R-T characteristic table calculating module 62 calculates an l-dimensional remote control opening degree vector θ (wherein l (ell) is a natural number not smaller than 2) for a remote control opening degree range of 0% (fully closed state) to 100% (fully open state) from the following expression (2) (Step S11). The remote control opening degree vector θ includes l components $\theta_j$ respectively having values which delimit l−1 zones obtained by equally dividing the remote control opening degree range between 0 and 100. Where l=101, for example, $\theta_j$=0, 1, 2, . . . , 100.

$$\hat{\theta}_j = \frac{100(j-1)}{l-1},\ j = 1, 2, \ldots, l \tag{2}$$

On the other hand, where a linear target R-N characteristic is set by the target characteristic setting module 67, an l-dimensional target engine speed vector N arranged to be linearly changed with respect to the remote control opening degree θ is given, for example, by the following expression (3). The expression (3) gives l target engine speeds $N_j$ which delimit l−1 zones obtained by equally dividing a target engine speed range defined between a minimum engine speed representative value (e.g., a minimum average engine speed) $N_1$ and a maximum engine speed representative value (e.g., a maximum average engine speed) $N_m$.

$$\hat{N}_j = \frac{\hat{\theta}_j}{100}(\overline{N}_m - \overline{N}_1) + \overline{N}_1 \tag{3}$$

wherein N and θ each affixed with a symbol "^" are defined as target values. This definition is the same in the following description.

Figure 7:
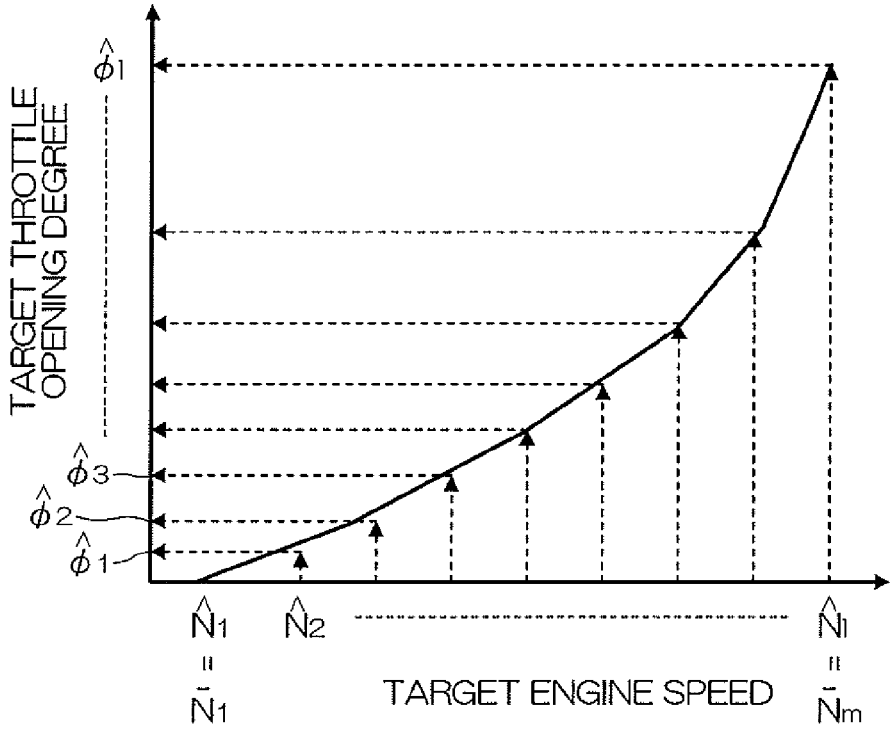
FIG. 7 is a diagram for explaining a target throttle opening degree determining process in which an engine speed in a target characteristic for a remote control opening degree-engine speed characteristic is fitted to an engine speed-throttle opening degree characteristic obtained by actual measurement for determination of a target throttle opening degree.

The R-T characteristic table calculating module 62 determines the throttle opening degrees $\phi_j$ for the target engine speeds $N_j$ obtained from the expression (3) by fitting the target engine speeds $N_j$ to the N-T characteristic table. If corresponding data is not present in the N-T characteristic table, the R-T characteristic table calculating module 62 determines the throttle opening degrees $\phi_j$ by linear interpolation based on proximate data. Thus, an l-dimensional target throttle opening degree vector φ is provided (Step S12). A relationship between the target throttle opening degree $\phi_j$ and the target engine speed $N_j$ is shown in FIG. 7.

In this manner, a data pair (θ,φ) of the l-dimensional remote control opening degree vector θ and the l-dimensional target throttle opening degree vector φ is provided. The data pair (θ,φ) is stored as an R-T characteristic table in the R-T characteristic table storage section 62M (Step S13). Thus, the R-T characteristic table is updated. By storing the new R-T characteristic table in the R-T characteristic table storage section 62M, the marine vessel maneuvering characteristic is changed. Therefore, the R-T characteristic table calculating module 62 causes the notifying unit 18 (functioning as an update notifying unit) to notify the operator that the marine vessel maneuvering characteristic has been updated (the R-T characteristic table has been updated) (Step S20).

Figure 8:
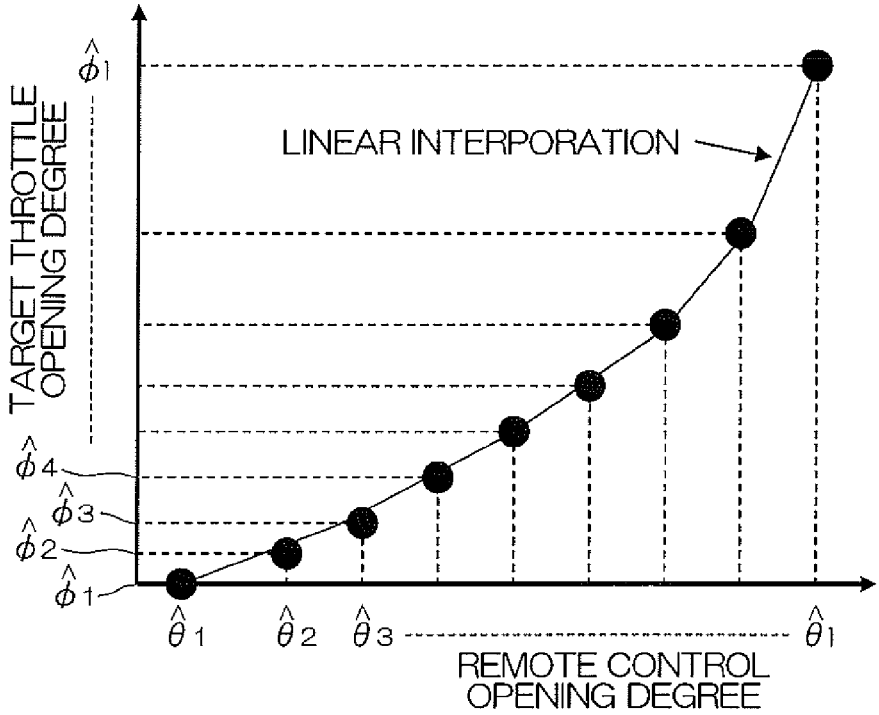
FIG. 8 is a diagram showing an exemplary remote control opening degree-target throttle opening degree characteristic.

An example of the R-T characteristic table is shown in FIG. 8. In this example, the throttle opening degree is changed nonlinearly with respect to the remote control opening degree. In a lower opening degree range, a steep change in the throttle opening degree is minimized. In a higher opening degree range, the throttle opening degree is highly responsive to the remote control opening degree. The target throttle opening degree is thus set to be nonlinear with respect to the remote control opening degree, whereby the engine speed of the engine 39 having the nonlinear characteristic as shown in FIG. 6 can be changed linearly with respect to the remote control opening degree.

After the R-T characteristic table is provided, the data collecting section 64 further judges whether the learning is to be ended, i.e., whether the collected learning data is sufficient (Step S14). If the data collecting section 64 judges that the learning is to be continued, the process sequence from Step S2 is repeated. When the R-T characteristic table is provided based on the sufficient learning data, the process ends.

If the data collecting section 64 judges in Step S2 that the engine 39 is in the over-rev state as judged by the over-rev judging section 69 (YES in Step S2), the data collecting section 64 turns on the over-rev flag (Step S15). Then, the data collecting section 64 skips Steps S3 to S8, and performs Step S9. That is, the collection of the learning data is prohibited, so that no abnormal data sample (see FIG. 5) is stored in the storage section 60. This eliminates the possibility that the calculation of the N-T characteristic table is based on the abnormal data samples. Thus, the setting of the R-T characteristic table is based on the N-T characteristic table determined based on the normal data samples. Therefore, the R-T characteristic table is properly set without adverse effects of the abnormal data samples. As a result, the operator does not suffer from unintended setting of the R-N characteristic. This improves the marine vessel maneuverability.

The ON state of the over-rev flag (YES in Step S3) means that the engine 39 is recovered from the over-rev state into the normal drive state. In this case, the data collecting section 64 turns off the over-rev flag (Step S16) and is kept in standby for a predetermined period (Step S17). The predetermined period is a stabilization period (e.g., about 10 seconds) required for stabilizing the engine 39 recovered from the over-rev state. After a lapse of the predetermined period (YES in Step S17), the data collecting section 64 performs a process sequence from Step S4.

If it is judged in Step S4 that the marine vessel 1 is not in the straight traveling state, Steps S5 to S8 are skipped. That is, no data sample is collected as the learning data.

Figure 9:
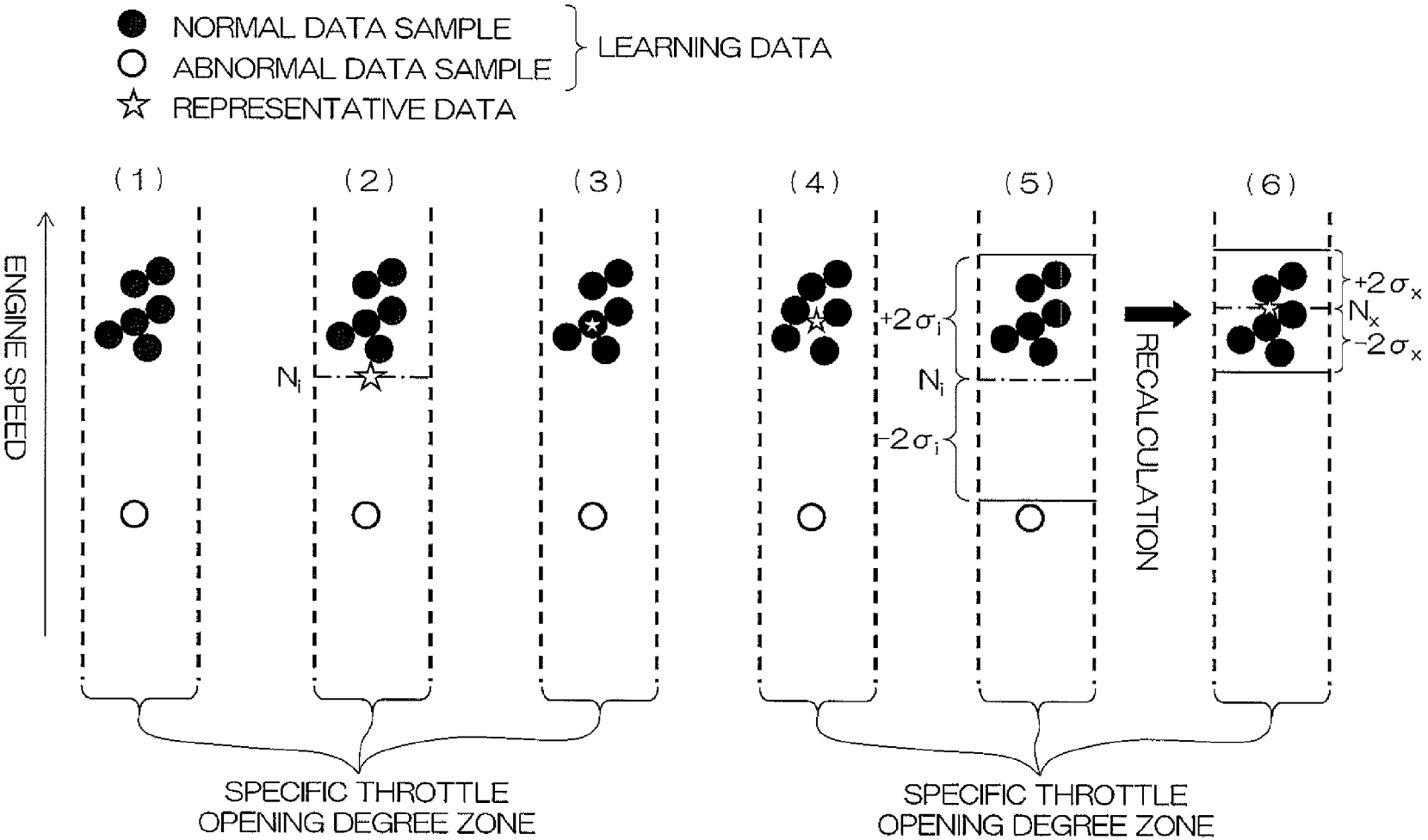
FIGS. 9(1) to 9(6) are diagrams each showing a sample space of a specific throttle opening degree zone containing a plurality of data samples of learning data and representative data.

FIGS. 9(1) to 9(6) are diagrams each showing a sample space of a specific throttle opening degree zone containing a plurality of data samples of the learning data and representative data. As described above, the N-T characteristic table calculating module 63 calculates the average engine speed $N_i$ and the average throttle opening degree $\phi_i$ as the representative data for each of the throttle opening degree zones $M_i$ based on the data samples of the learning data classified in the zone $M_i$ (Step S10).

In a sample space shown in FIG. 9(1), the acquired learning data includes normal data samples clustering in a normal data distribution range, and an abnormal data sample located significantly apart from the normal data distribution range. As in FIG. 5, the normal data samples are each indicated by a black circle, and the abnormal data sample is indicated by a white circle. In sample spaces shown in FIGS. 9(2) to 9(6), plots of the representative data are each indicated by a star mark.

As described above, the acquisition of the abnormal data sample attributable to the over-rev of the engine 39 is prohibited (Step S2 in FIG. 4). In other words, the abnormal data sample attributable to the over-rev of the engine 39 is detected by the over-rev judging section 69, and eliminated so as not to be acquired as the learning data by the data collecting section 64. Thus, the representative data is determined based on the learning data excluding the abnormal data sample attributable to the over-rev. Therefore, the N-T characteristic table is calculated based on the learning data excluding the abnormal data sample attributable to the over-rev. This improves the reliability of the R-T characteristic table determined based on the N-T characteristic table, so that the R-N characteristic can be adapted for the operator's preference.

However, the abnormal data sample is attributable not only to the over-rev of the engine 39 but also to a sudden change in a load applied to the engine 39. One exemplary cause of the sudden load change is knocking. Another exemplary cause of the sudden load change is a change in the attitude of the hull 2 occurring when the marine vessel 1 is subjected to wind gust or travels on a strong tidal current. Since it is difficult to detect and eliminate the abnormal data sample attributable to the causes other than the over-rev of the engine 39 for prevention of the data acquisition by the data collecting section 64, the abnormal data sample is liable to be acquired as the learning data.

Exemplary cases will hereinafter be described, in which the abnormal data sample acquired by the data collecting section 64 is attributable to an excessively low engine speed and therefore is located below the normal data distribution range.

FIG. 9(2) is a diagram for explaining a case in which the N-T characteristic table calculating module 63 determines the representative data by averaging all the learning data including the abnormal data sample. In this case, the average engine speed $N_i$ is liable to deviate from the normal data distribution range to a lower speed side. This adversely affects the reliability of the N-T characteristic table and the R-T characteristic table.

Therefore, the N-T characteristic table calculating module 63 is preferably arranged to eliminate the abnormal data sample through a statistic analysis by using a median, a trimmed mean and/or a standard deviation after the acquisition of the abnormal data sample by the data collecting section 64 so as to eliminate the adverse effect of the abnormal data sample on the representative data.

The median is a center value of the learning data determined by arranging the data samples in order of increasing or decreasing engine speed. Where seven data samples (an odd number of data samples) including an abnormal data sample are present as the learning data in a sample space shown in FIG. 9(3), for example, the fourth data sample in a data sample sequence obtained by arranging the seven data samples in order of increasing or decreasing engine speed is the median. If six data samples (an even number of data samples) are present as the learning data in the sample space, an average of the third and fourth data samples in a data sample sequence obtained by arranging the six data samples in order of increasing or decreasing engine speed is the median. If a single data sample is present as the learning data in the sample space, this data sample is the median. There is no possibility that the abnormal data sample falling outside the normal data distribution range could be the median of the learning data. In this case, the N-T characteristic table calculating module 63 functions as a median computing unit, which is arranged to compute the median of the learning data as the representative data. Even if the abnormal data sample is included in the learning data, the abnormal data sample is eliminated after the acquisition of the learning data. Thus, the N-T characteristic table and the R-T characteristic table can be reliably determined based only on the normal data samples.

The trimmed mean is an average of learning data remaining after higher- and lower-end data samples in a data sample sequence obtained by arranging the learning data samples in order of increasing or decreasing engine speed are removed from the original learning data (or after the original learning data is trimmed). The data samples to be removed include data samples located in predetermined higher- and lower-end ranges including the highest end and the lowest end in the data sample sequence. The predetermined ranges may be each defined as a data sample number range or an engine speed range. In a sample space shown in FIG. 9(4), an average of learning data excluding a data sample having the highest engine speed and a data sample (abnormal data sample) having the lowest engine speed is the trimmed mean. There is no possibility that the abnormal data sample falling outside the normal data distribution range could be used for the calculation of the trimmed mean of the learning data. In this case, the N-T characteristic table calculating module 63 functions as a trimmed mean computing unit, which is arranged to compute the trimmed mean of the learning data as the representative data. Even if the abnormal data sample is included in the learning data, the abnormal data sample is eliminated after the acquisition of the learning data. Thus, the N-T characteristic table and the R-T characteristic table can be reliably determined based only on the normal data samples.

Figure 10:
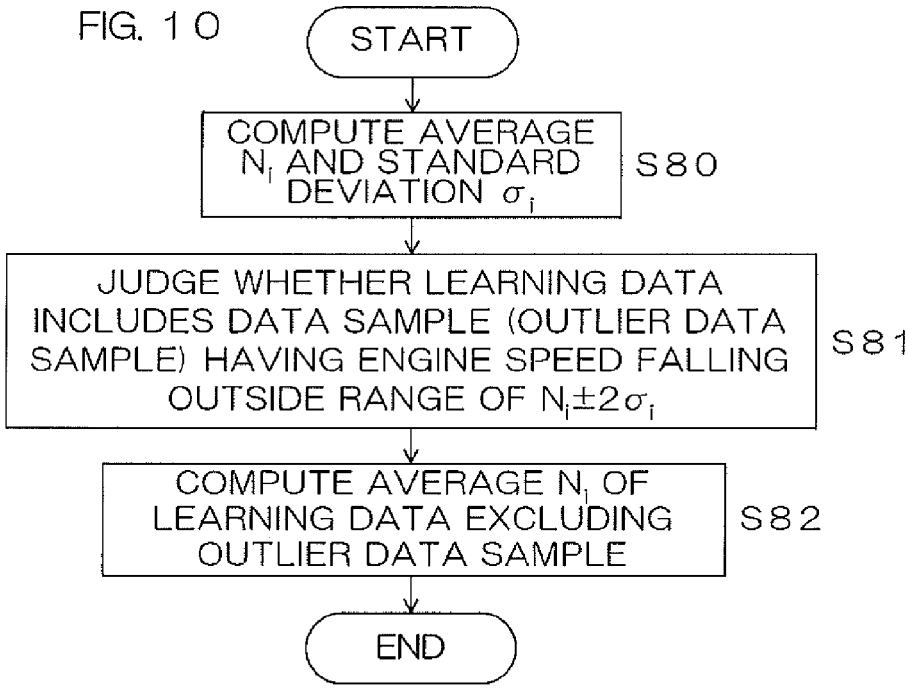
FIG. 10 is a flow chart for explaining an exemplary process for calculating the representative data by using a standard deviation.

FIG. 10 is a flow chart for explaining an exemplary process for calculating the representative data by using the standard deviation. The N-T characteristic table calculating module 63 herein functions as an average computing unit, a standard deviation computing unit, a to-be-processed actual data updating unit, an average updating unit and a standard deviation updating unit.

The N-T characteristic table calculating module 63 calculates an average engine speed $N_i$ and a standard deviation $\sigma_i$ of all the learning data (including the abnormal data sample attributable to the causes other than the over-rev of the engine 39) in the specific throttle opening degree zone (Step S80). Then, the N-T characteristic table calculating module 63 judges whether the learning data includes a data sample (hereinafter referred to as "outlier data sample") having an engine speed that deviates from the average engine speed $N_i$ by a distance not less than a predetermined integer multiple of the standard deviation $\sigma_i$ (preferably by a distance equal to about one or more times the standard deviation $\sigma_i$ and, in this preferred embodiment, by a distance equal to about twice the standard deviation $\sigma_i$) (Step S81). Then, the N-T characteristic table calculating module 63 determines an average engine speed $N_x$ of learning data excluding the outlier data sample as the representative data (Step S82). The N-T characteristic table calculating module 63 also determines an average throttle opening degree of the learning data excluding the outlier data sample.

As shown in sample spaces of FIGS. 9(5) and 9(6), the abnormal data sample is eliminated as the outlier data sample by the N-T characteristic table calculating module 63, whereby the learning data (to-be-processed actual data) is updated so as to include only the normal data samples. In other words, the N-T characteristic table calculating module 63 computes the average and the standard deviation of the original learning data (original to-be-processed actual data), and updates the learning data by eliminating the abnormal data sample based on the average and the standard deviation. Then, the N-T characteristic table calculating module 63 recalculates (updates) the average of the updated learning data. Thus, the updated average necessarily falls within the normal data distribution range. The N-T characteristic table calculating module 63 adopts the updated average as the representative data. Even if the abnormal data sample is included in the original learning data, the abnormal data sample is eliminated after the acquisition of the original learning data. As a result, the N-T characteristic table and the R-T characteristic table can be reliably determined based only on the normal data samples.

Figure 11:
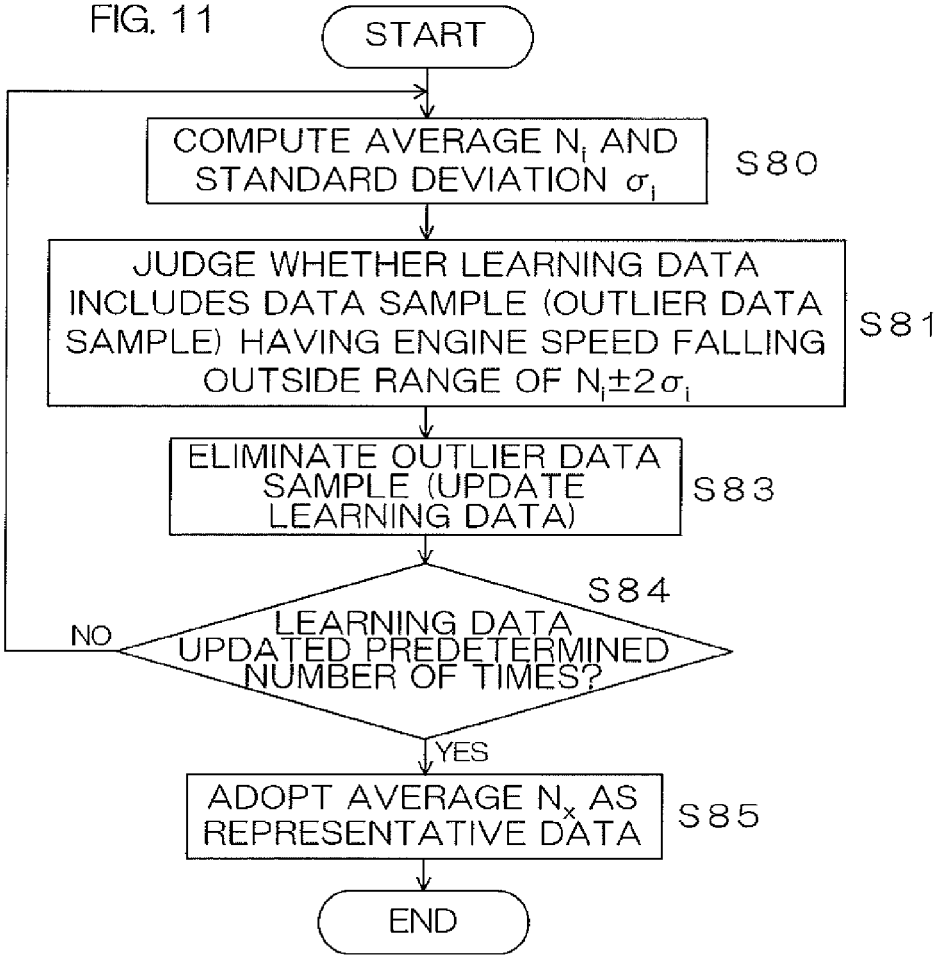
FIG. 11 is a flow chart for explaining another exemplary process for calculating the representative data by using the standard deviation.

FIG. 11 is a flow chart for explaining another exemplary process for calculating the representative data by using the standard deviation. In FIG. 11, steps corresponding to those shown in FIG. 10 will be indicated by the same step numbers.

The N-T characteristic table calculating module 63 repeatedly performs a process sequence (Steps S80 to S83) a predetermined number of times to remove an outlier data sample by calculating the average engine speed $N_i$ and the standard deviation $\sigma_i$ and judging whether the learning data includes an outlier data sample (Step S84). That is, the N-T characteristic table calculating module 63 repeatedly updates the learning data (by removing the outlier data sample), so that the number of the data samples of the learning data is reduced. Upon the update of the learning data, the average engine speed $N_i$ and the standard deviation $\sigma_i$ are also updated. After every update, the standard deviation $\sigma_i$ decreases, and the average $N_i$ approaches the center of the normal data distribution. The N-T characteristic table calculating module 63 further updates the learning data based on the average engine speed $N_i$ and the standard deviation $\sigma_i$ thus updated, whereby the remaining learning data includes only data samples located closer to the center of the normal data distribution. After the update of the learning data is repeated the predetermined number of times (YES in Step S84) the N-T characteristic table calculating module 63 adopts the average $N_x$ of the finally obtained learning data as the representative data (Step S85).

By thus repeating the update of the learning data, the abnormal data sample can be reliably removed from the learning data, and the outlier data samples located in the normal data distribution range but apart from the center of the normal data distribution can be removed from the learning data. Thus, highly reliable representative data can be provided based on the normal data samples located closer to the center of the normal data distribution (based on highly reliable normal data samples). As a result, the N-T characteristic table and the R-T characteristic table can be determined as having higher reliability.

Figure 12:
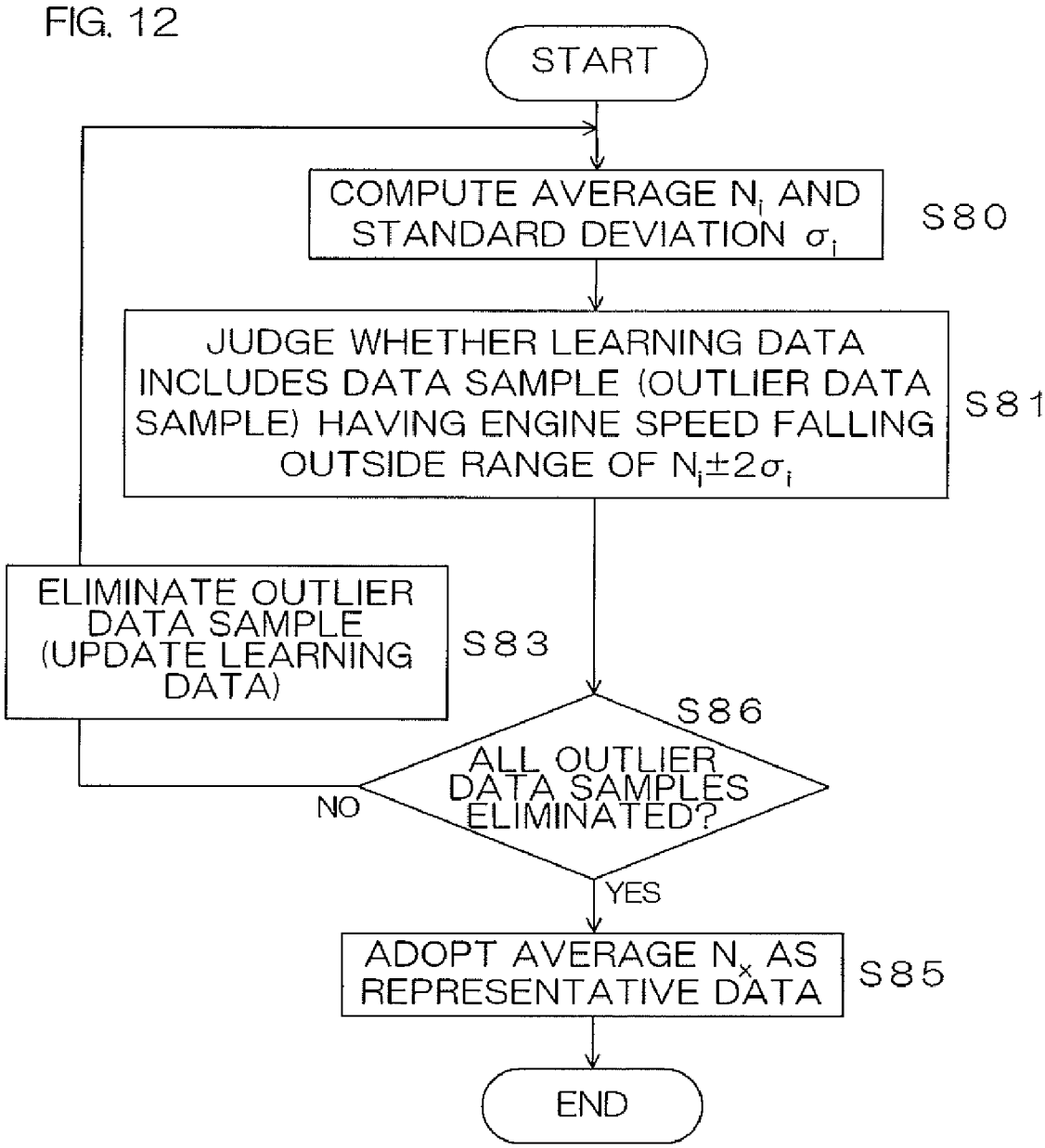
FIG. 12 is a flow chart for explaining further another exemplary process for calculating the representative data by using the standard deviation.

FIG. 12 is a flow chart for explaining further another exemplary process for calculating the representative data by using the standard deviation. In FIG. 12, steps corresponding to those shown in FIG. 11 will be indicated by the same step numbers.

As described above, the reliability of the representative data is improved by repeating the update of the learning data the predetermined number of times. Therefore, the N-T characteristic table calculating module 63 preferably repeats the update of the learning data until all the outlier data samples are removed (Step S86). Thus, the abnormal data samples and the outlier data samples are reliably removed from the learning data, so that the average $N_x$ of the finally updated learning data is as close as possible to the center of the normal data distribution. Since only the highly reliable normal data samples are thus acquired, the reliability of the representative data is further improved. As a result, the N-T characteristic table and the R-T characteristic table are determined as having further higher reliability.

In the processes utilizing the standard deviation, the aforementioned median may be used as the representative data.

Figure 13:
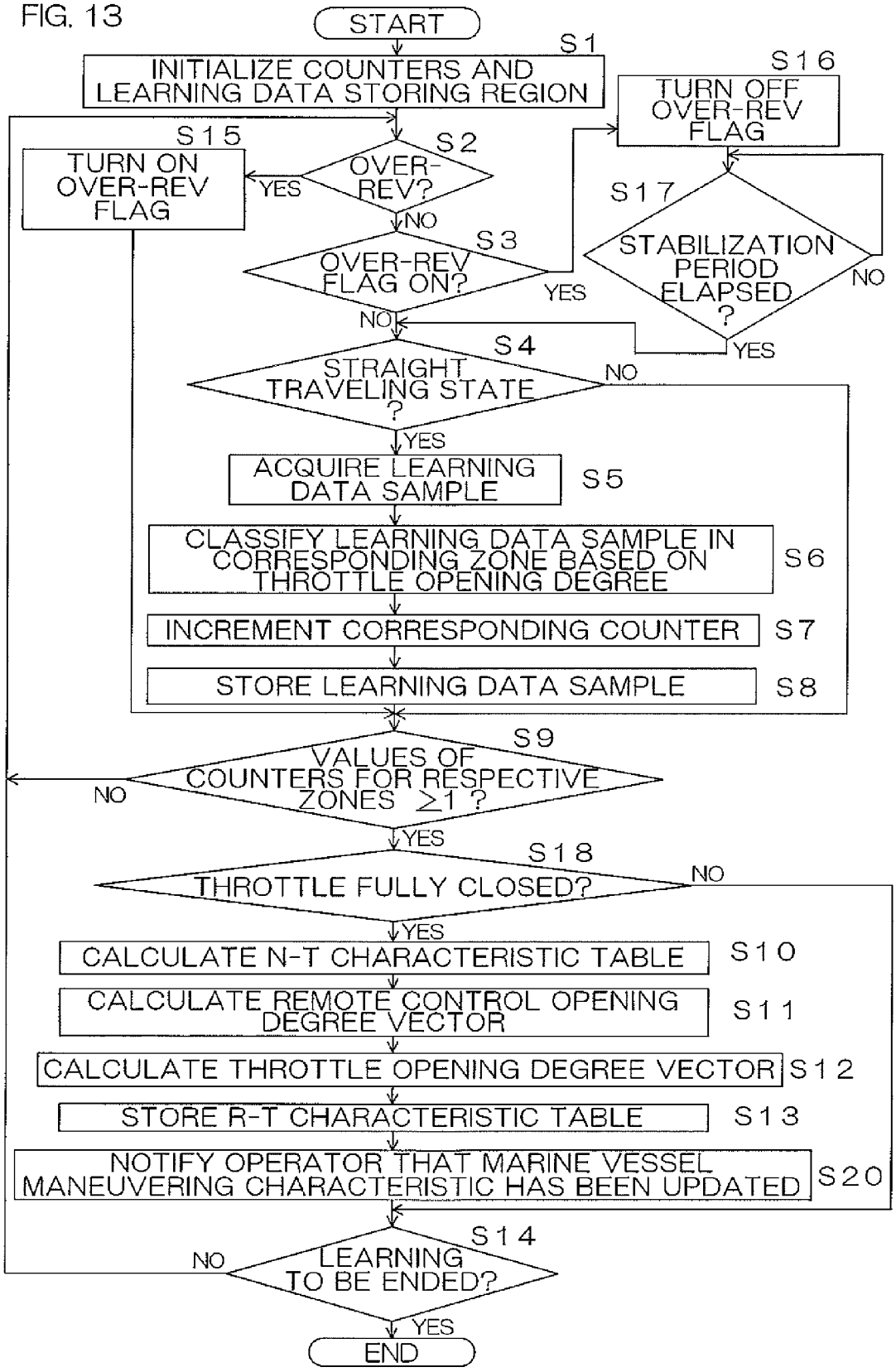
FIG. 13 is a flow chart for explaining an exemplary process for minimizing an uncomfortable feeling which may otherwise occur in a crew of the marine vessel when the remote control opening degree-target throttle opening degree characteristic is changed.
Figure 14:
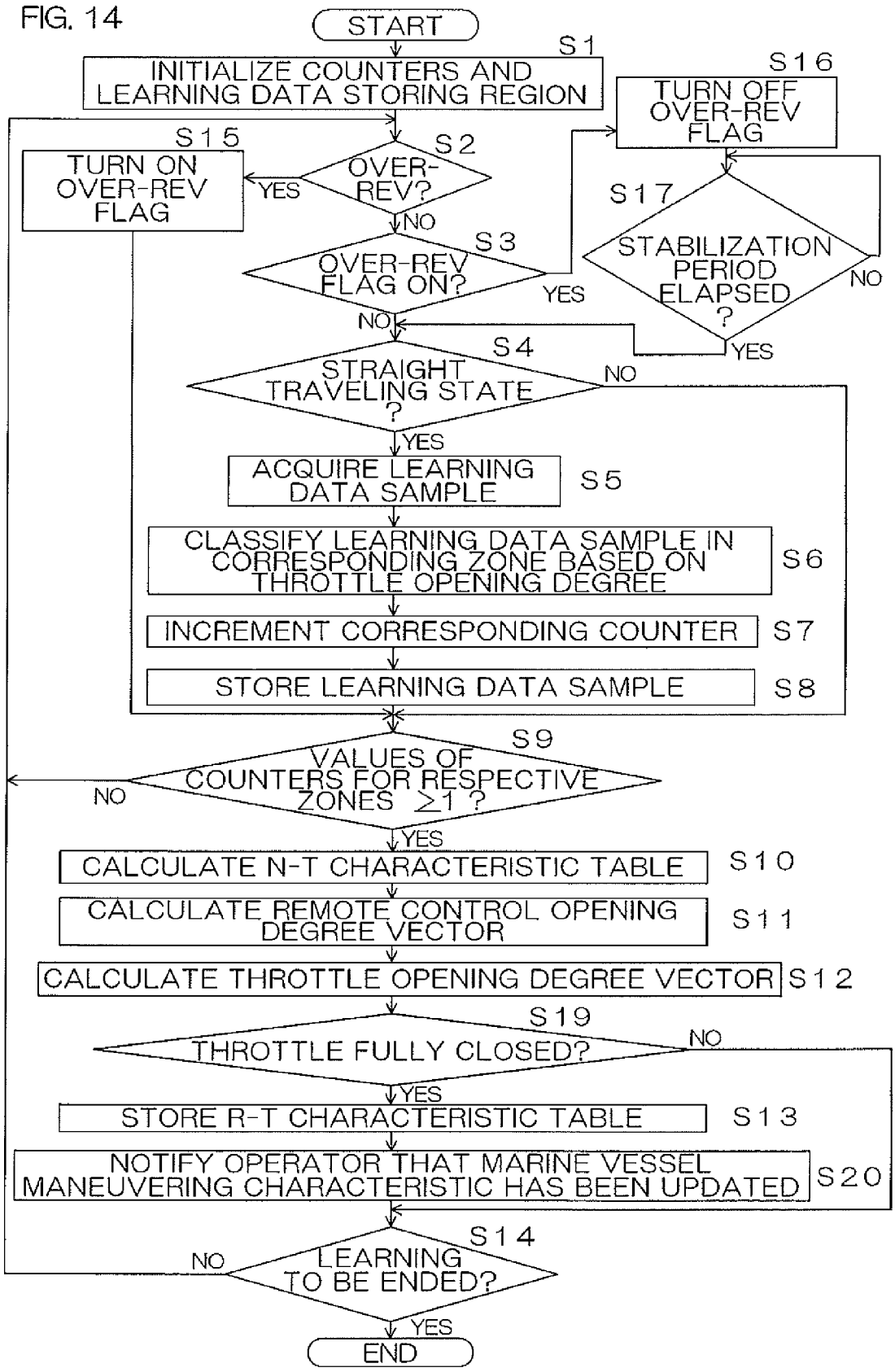
FIG. 14 is a flow chart for explaining another exemplary process for minimizing an uncomfortable feeling which may otherwise occur in the crew when the remote control opening degree-target throttle opening degree characteristic is changed.

Even if the learning data is acquired for each of the zones $M_1$ to $M_7$ to permit the calculation of the R-T characteristic table, the update of the R-T characteristic during the travel of the marine vessel may lead to a sudden change in the engine speed, causing an uncomfortable feeling in the crew or passengers of the marine vessel. This problem may be eliminated, for example, as shown in FIG. 13, by causing the N-T characteristic table calculating module 63 and the R-T characteristic table calculating module 62 to perform their operations only when the shift position is set at the neutral position, i.e., the throttle opening degree is 0% (Step S18). Alternatively, this problem may be eliminated, as shown in FIG. 14, by causing the N-T characteristic table calculating module 63 and the R-T characteristic table calculating module 62 to perform their operations irrespective of the throttle opening degree, and permitting the rewrite of the R-T characteristic table storage section 62M to be referred to by the target throttle opening degree calculating module 61 only when the throttle opening degree is 0% (Step S19).

The expression (3) indicating the target R-N characteristic may be generalized by the following expression (4) in the form of a function f(θ).

$$\hat{N}=f(\hat{\theta}) \tag{4}$$

That is, the target R-N characteristic is not limited to the linear characteristic, but may be set to any of various characteristics. Any of these target R-N characteristics is used for performing Steps S11 to S13, whereby the R-T characteristic table is prepared which is adapted to achieve the target R-N characteristic.

Where the N-T characteristic table is completed by the learning (measurement), any of various R-N characteristics can be provided simply by performing Steps S11 to S13.

Figure 15:
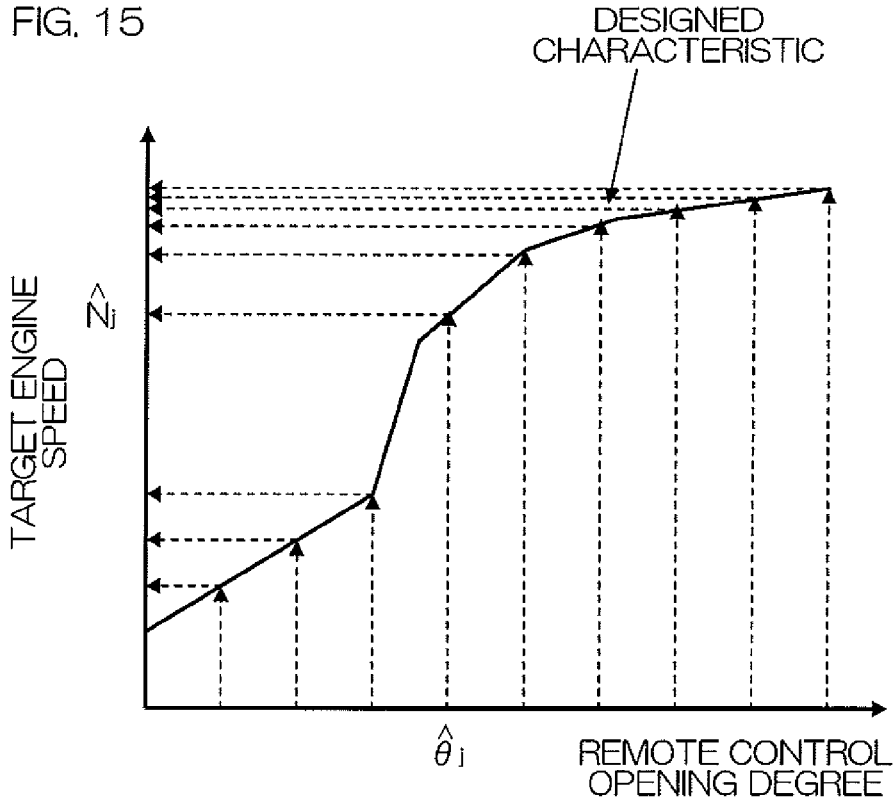
FIG. 15 is a diagram illustrating an exemplary nonlinear target engine speed characteristic with respect to a remote control opening degree.

FIG. 15 is a diagram illustrating an example of a nonlinear target engine speed characteristic with respect to the remote control opening degree (target R-N characteristic). In this example, the target engine speed is minimized to a lower level in the lower opening degree range, and steeply changed with respect to the remote control opening degree in a middle opening degree range. Further, the target engine speed is moderately changed with respect to the remote control opening degree in the higher opening degree range.

Figure 16:
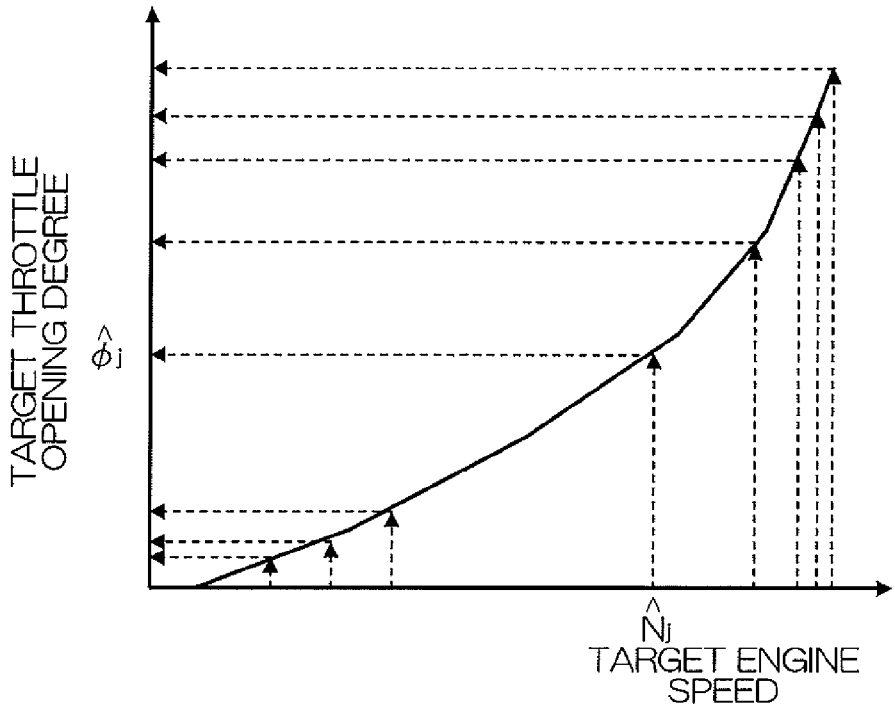
FIG. 16 is a diagram for explaining a process for determining a target throttle opening degree by fitting a target engine speed shown in FIG. 15 to an engine speed-throttle opening degree characteristic obtained by actual measurement.

A remote control opening degree vector θ for this target R-T characteristic is determined by equally dividing the entire remote control opening degree range according to the expression (2). Then, target engine speeds $N_j$ for respective remote control opening degrees $\theta_j$ are determined to provide a target engine speed vector N. As shown in FIG. 16, the components $N_j$ of the target engine speed vector N are fitted to the N-T characteristic table for determining corresponding target throttle opening degrees $\phi_j$, whereby a target throttle opening degree vector φ for the remote control opening degree vector θ is provided. Thus, an R-T characteristic table is provided.

Figure 17:
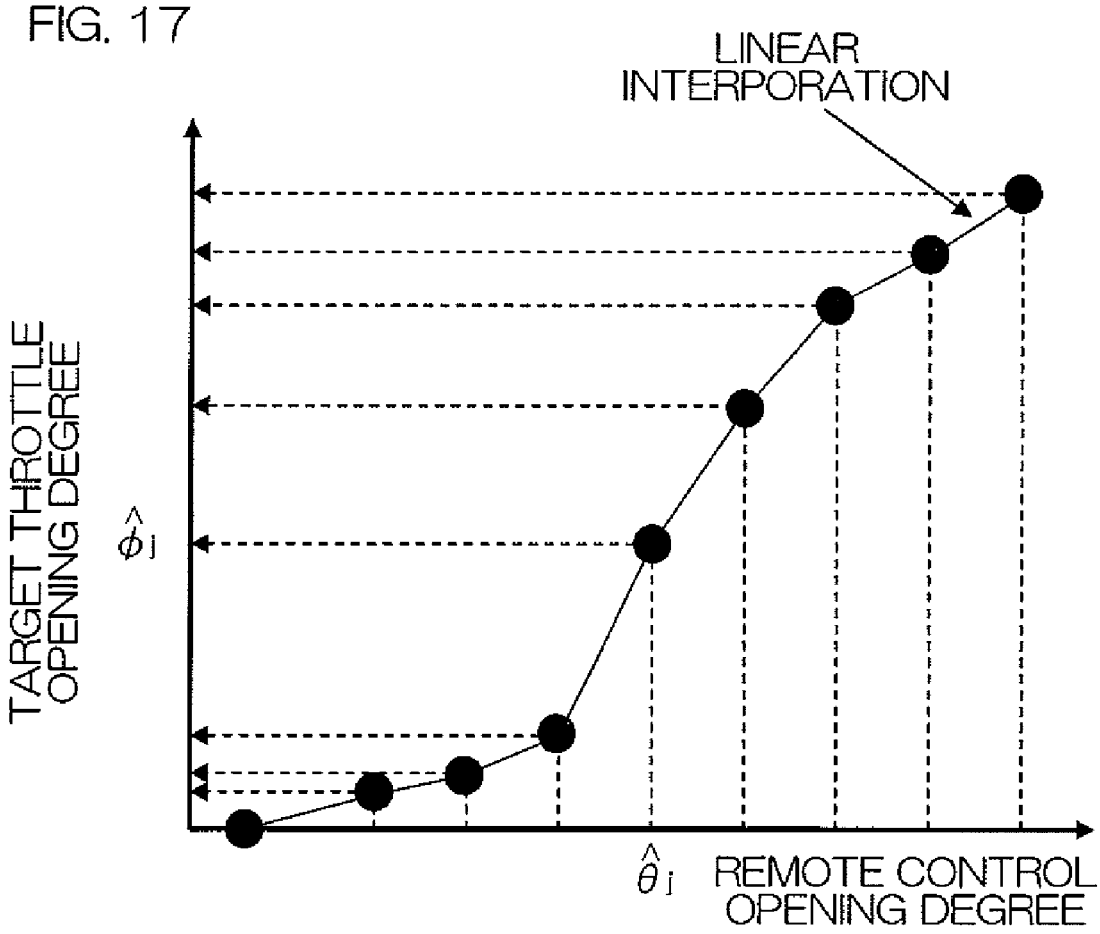
FIG. 17 is a diagram showing an exemplary remote control opening degree-target throttle opening degree characteristic determined by the process explained with reference to FIG. 16.

An example of the R-T characteristic table is shown in FIG. 17. Since the target R-T characteristic is nonlinear, the components $N_j$ of the target engine speed vector N are not equidistantly plotted on the target engine speed axis in FIG. 16.

Next, the operation of the target characteristic setting module 67 will be described.

Figure 18:
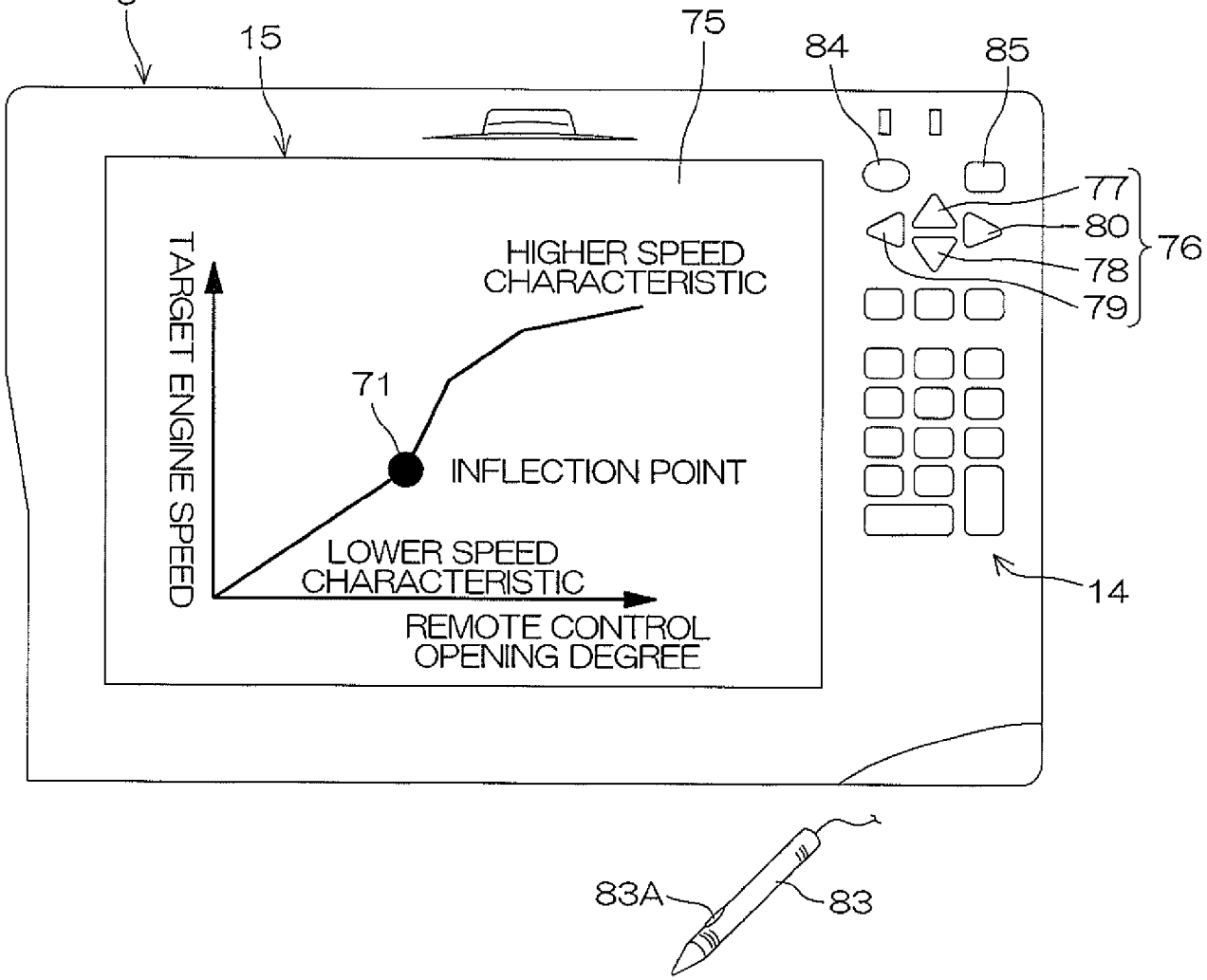
FIG. 18 is a diagram illustrating an exemplary target characteristic inputting section including an input device and a display device in combination.

FIG. 18 is a diagram illustrating an example of the target characteristic inputting section 9 including the input device 14 and the display device 15 in combination. A graph of the target engine speed characteristic with respect to the remote control opening degree (target R-N characteristic) is displayed on a screen of the display device 15. In the graph, a target R-N characteristic curve defining the target R-N characteristic has an inflection point 71. A portion of the target R-N characteristic curve in a higher opening degree range (between the inflection point 71 and the remote control opening degree upper limit (fully opened state)) defines a higher speed characteristic, and a portion of the target R-N characteristic curve in a lower opening degree range (between the remote control opening degree lower limit (fully closed state) and the inflection point 71) defines a lower speed characteristic. The operator sets the target characteristic by changing the position of the inflection point 71 and changing the shape of the lower speed characteristic curve portion and/or the shape of the higher speed characteristic curve portion. In this preferred embodiment, however, the operator is permitted to move the inflection point 71 only along a linear portion of the characteristic curve. Where the target R-N characteristic curve is linear or includes a single upward or downward projection and hence has no inflection point, the inflection point 71 is initially positioned, for example, at the median (50%) of the remote control opening degree on the target R-N characteristic curve.

The input device 14 preferably includes, for example, a touch panel 75, a touch pen 83, a cross button 76, a characteristic changing button 84, and a higher speed characteristic button 85 (to-be-changed portion specifying unit). The touch panel 75 is provided on the screen of the display device 15. The touch pen 83 is used for operating the touch panel 75. The cross button 76 is provided on a lateral side of the screen of the display device 15. The characteristic changing button 84 is used for adopting a change made in the target R-N characteristic. The higher speed characteristic button 85 is operated when the higher speed characteristic is to be changed. The cross button 76, the characteristic changing button 84 and the higher speed characteristic button 85 define a key input unit.

Figure 19:
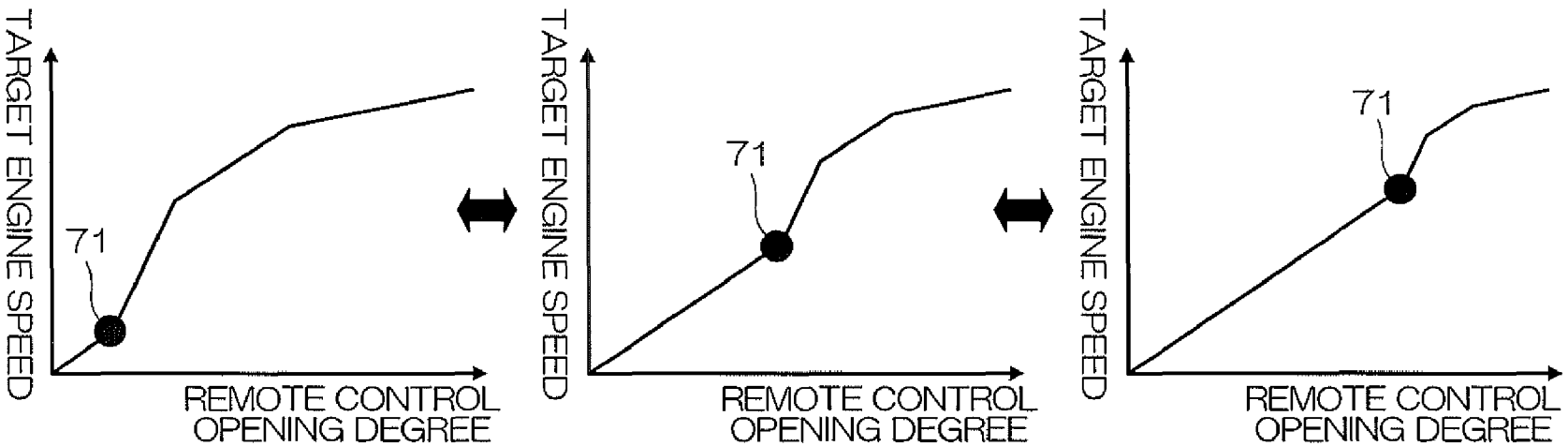
FIG. 19 is a diagram for explaining how to change the position of an inflection point on a target characteristic curve.

The cross button 76 includes upper and lower buttons 77, 78 (curve shape change inputting unit), and left and right buttons 79, 80 (inflection point position change inputting unit). In this preferred embodiment, the inflection point 71 of the target R-N characteristic curve is moved laterally as shown in FIG. 19, for example, by operating the left and right buttons 79, 80 of the cross button 76. In this preferred embodiment, the operation of the left and right buttons 79, 80 causes the inflection point 71 to move along the linear portion of the characteristic curve indicating a linear characteristic of the engine speed with respect to the remote control opening degree.

Figure 20:
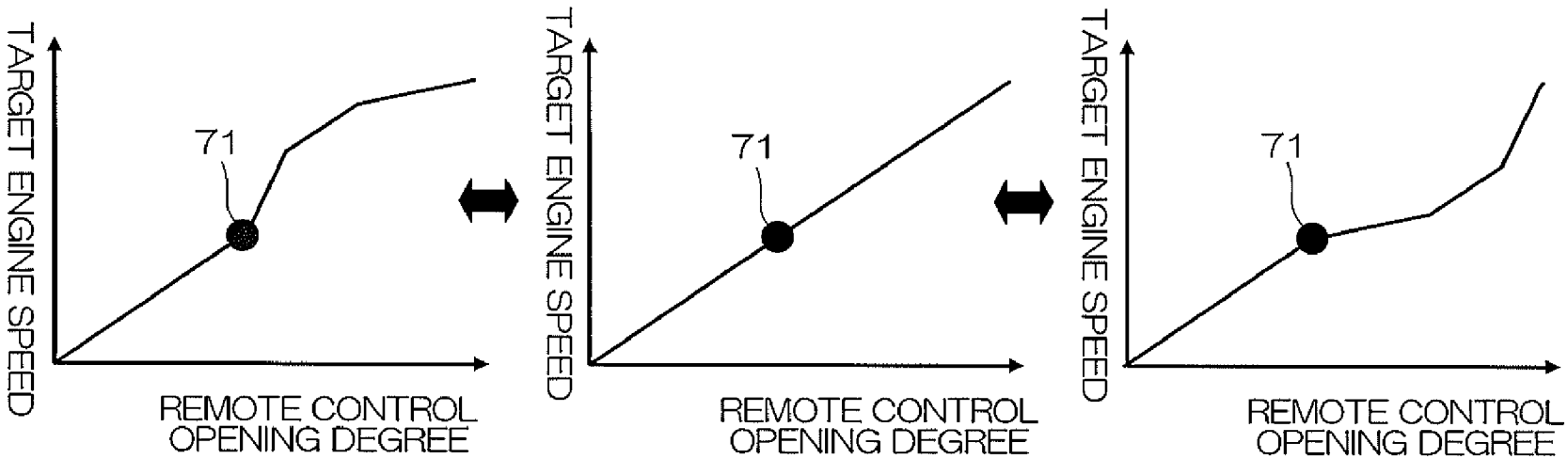
FIG. 20 is a diagram for explaining how to change the shape of the target characteristic curve.

Further, the shape of the target R-N characteristic curve is changed by operating the upper and lower buttons 77, 78 of the cross button 76. Thus, the shape of the R-N characteristic curve is changed as desired. For example, the shape of the R-N characteristic curve can be changed to an upwardly projecting shape (as shown in a left graph in FIG. 20) or a downwardly projecting shape (as shown in a right graph in FIG. 20) based on a linear characteristic (as shown in a middle graph in FIG. 20). At this time, the shape of the higher speed characteristic curve portion can be changed by operating the upper and lower buttons 77, 78 while operating the higher speed characteristic button 85. Further, the shape of the lower speed characteristic curve portion can be changed by operating the upper and lower buttons 77, 78 without operating the higher speed characteristic button 85.

The aforementioned operations can also be performed with the use of the touch panel 75 and the touch pen 83. More specifically, the position of the inflection point 71 is changed along the linear portion of the characteristic curve by pointing the inflection point 71 by the touch pen 83 and laterally dragging the inflection point 71 while pressing a click button 83A provided on the touch pen 83. Further, the shape of the higher speed characteristic curve portion is changed by performing a dragging operation in the higher speed characteristic range, and the shape of the lower speed characteristic curve portion is changed by performing the dragging operation in the lower speed characteristic range. Thus, the touch panel 75 and the touch pen 83 also serve as the inflection point position change inputting unit and the curve shape change inputting unit.

Figure 21:
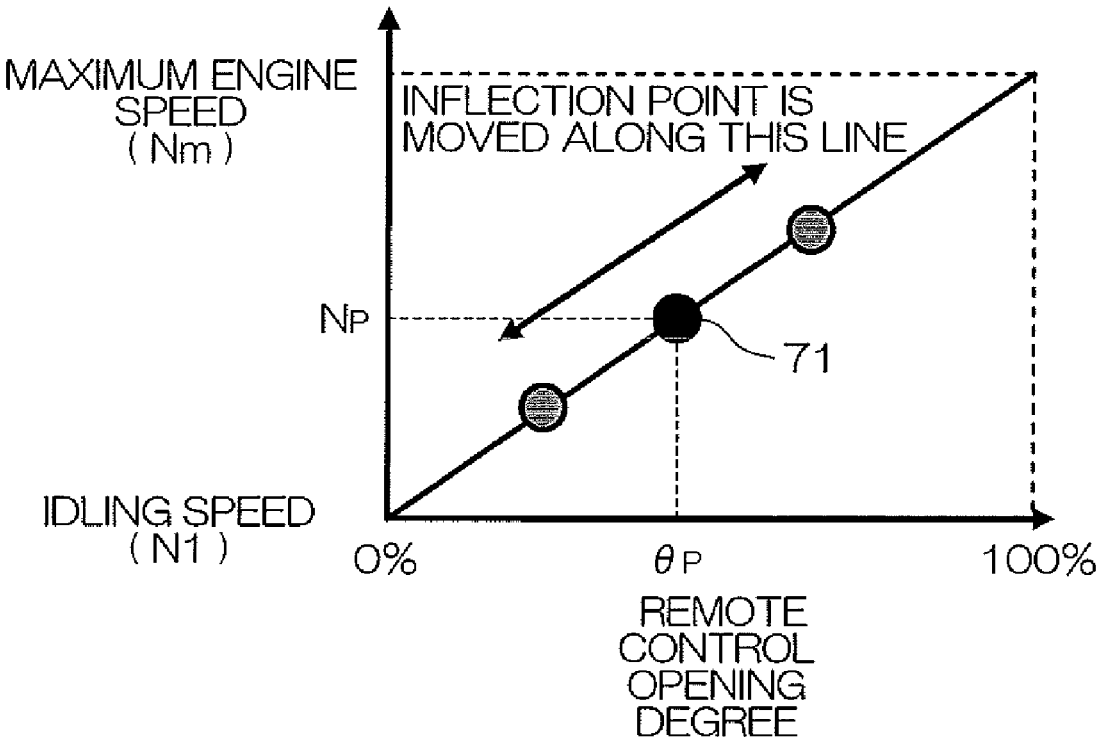
FIG. 21 is a diagram for explaining a straight line defining a linear characteristic and movement of an inflection point on the line.

As shown in FIG. 21, the linear characteristic is defined by a straight line that extends from a point defined by an idling engine speed ($N_1$) observed in the remote control lever fully closed state ($\theta$=0) to a point defined by a maximum engine speed ($N_m$) observed in the remote control lever fully open state ($\theta$=100). When the remote control opening degree $\theta_p$ at the inflection point 71 is determined, the engine speed $N_p$ for the remote control opening degree $\theta_p$ is given by the following expression (5):

$$N_p = \frac{N_m - N_1}{100}\theta_p + N_1 \tag{5}$$

wherein determination of the inflection point ($\theta_p$,$N_p$), the lower speed characteristic is defined by a lower speed characteristic curve portion having opposite ends (0,$N_1$) and ($\theta_p$, $N_p$), and the higher speed characteristic is defined by a higher speed characteristic curve portion having opposite ends ($\theta_p$, $N_p$) and (100,$N_m$). Average values $N_1$ and $N_m$ calculated from the aforementioned expression (1) are used as the values $N_1$ and $N_m$, but other values preliminarily determined may be used as the values $N_1$ and $N_m$.

The higher speed characteristic curve portion and the lower speed characteristic curve portion are defined, for example, by the following expression (6):

$$N = \begin{cases} \left(\frac{\theta}{\theta p}\right)^{k_1} N_p & \text{Lower speed characteristic} \\ \left(\frac{\theta - \theta_p}{100 - \theta_p}\right)^{k_h} (N_m - N_p) + N_p & \text{Higher speed characteristic} \end{cases} \tag{6}$$

wherein $k_l$ and $k_h$ are setting parameters which are variable in ranges of $0.1 \leqq k_l$ and $k_h \leqq 10$, and where $k_l = k_h = 1$, the engine speed characteristic is linear.

The inflection point is preferably set at an engine speed (e.g., about 2,000 rpm) which is slightly lower than an engine speed generally used for increasing the speed of the marine vessel over the hump range (a speed range in which a wave-making resistance is maximum). By thus setting the inflection point, it is possible to provide a lower speed characteristic suitable for maneuvering the marine vessel at a lower traveling speed below the hump range (e.g., for moving the marine vessel toward or away from a docking site or for trolling) as well as a higher speed characteristic suitable for maneuvering the marine vessel at a traveling speed higher than the hump range (e.g., for long-distance cruising).

The lower speed characteristic, which is adapted for an engine speed range generally used for moving the marine vessel toward or away from a docking site or for trolling, should be set by giving primary consideration to the maneuverability of the marine vessel. In general, the lower speed characteristic is set to be linear, or determined such that the engine speed is less liable to increase even if the remote control lever 8*a* is substantially operated. This prevents the steep increase in the engine speed, and facilitates the fine control of the engine output.

On the other hand, the higher speed characteristic is adapted for an engine speed range generally used when the engine is required to have higher responsiveness, e.g., when the marine vessel travels at a relatively high speed or travels on high waves. In general, the higher speed characteristic is set to be linear, or determined such that the engine speed is more liable to increase with higher responsiveness even if the remote control lever is slightly operated. Thus, a desired engine output can be provided quickly in response to the operation of the remote control lever 8*a* without fully inclining the remote control lever 8*a*. Therefore, the higher speed characteristic thus set is effective, for example, when the marine vessel travels over waves on rough seas. Since the inflection point is set in the lower engine speed range lower than the hump range, the marine vessel can be easily brought into a planing state (in which a frictional resistance is predominant with a reduced wave-making resistance).

As described above, the target characteristic curve may have an upward or downward projection with respect to the linear characteristic. In this preferred embodiment, however, the following restrictions 1 to 3 are preferably imposed for setting the lower and higher speed characteristics on opposite sides of the inflection point.

Restriction 1: If one of the lower speed characteristic curve portion and the higher speed characteristic curve portion projects upward, the other characteristic curve portion should be linear or project downward.

Restriction 2: If one of the lower speed characteristic curve portion and the higher speed characteristic curve portion projects downward, the other characteristic curve portion should be linear or project upward.

Restriction 3: If one of the lower speed characteristic curve portion and the higher speed characteristic curve portion is linear, the other characteristic curve portion may be linear or project upward or downward.

These restrictions prevent the lower and higher speed characteristic curve portions on the opposite sides of the inflection point from projecting in the same direction (upward or downward), thereby ensuring continuity of the lower and higher speed characteristic curve portions. Where it is desired to set the target characteristic such that the characteristic curve projects upward or downward over the entire remote control opening degree range, the setting of the characteristic curve may be achieved by setting the inflection point at the idling engine speed, i.e., at a remote control opening degree of 0%, and then setting the higher speed characteristic curve portion. Alternatively, the setting of the characteristic curve may be achieved by setting the inflection point at the maximum engine speed, i.e., at a remote control opening degree of 100%, and then setting the lower speed characteristic curve portion.

The target R-N characteristic curve may be set when the marine vessel is in a stopped state or in a traveling state.

Figure 22:
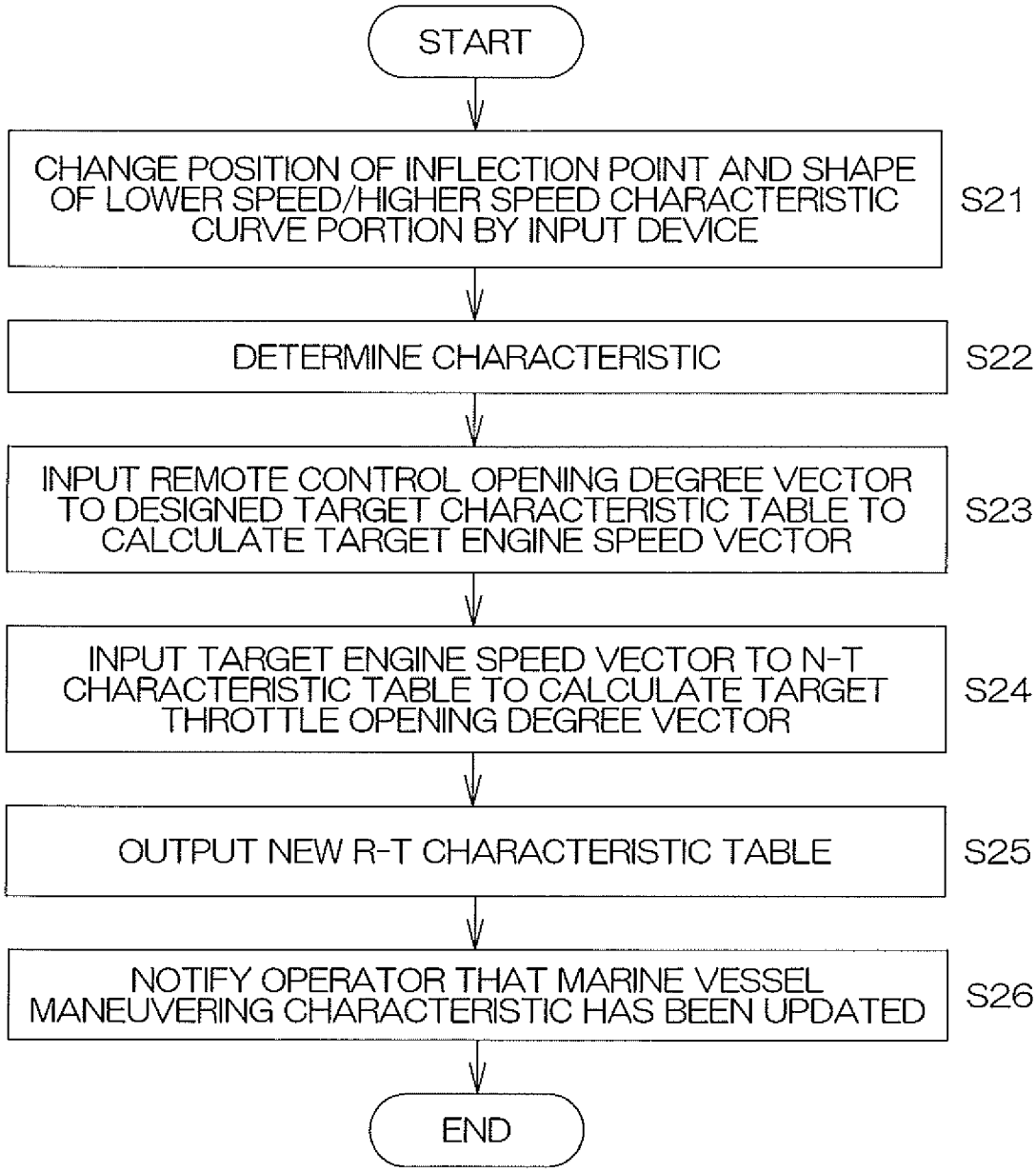
FIG. 22 is a flow chart for explaining a process to be performed for setting the target characteristic curve when the marine vessel is in a stopped state.

FIG. 22 is a flow chart for explaining a process to be performed for setting the target R-N characteristic curve when the marine vessel is in the stopped state (when the shift position is set at the neutral position). The operator checks the target R-N characteristic curve displayed on the display device 15, and performs a characteristic curve setting operation with the use of the touch panel 75 or the cross button 76. When the operator specifies the inflection point 71 and laterally moves the inflection point 71 on the touch panel 75 (see FIG. 21), for example, the inflection point 71 is moved along the linear characteristic curve. When the operator specifies the higher speed characteristic curve portion or the lower speed characteristic curve portion and moves up or down the characteristic curve portion on the touch panel 75, the characteristic curve portion is caused to project upward or downward (Step S21).

After roughly setting the characteristic curve, the operator presses the characteristic changing button 84 (Step S22). In response to the pressing of the characteristic changing button 84, the target characteristic setting module 67 generates a target characteristic table according to the setting of the characteristic curve, and stores the generated target characteristic table in the target R-N characteristic table storage section 67M. The R-T characteristic table calculating module 62 inputs a remote control opening degree vector θ to the generated target characteristic table, and calculates a target engine speed vector N (Step S23). Further, the R-T characteristic table calculating module 62 inputs the target engine speed vector N to the N-T characteristic table, and calculates a target throttle opening degree vector ϕ (Step S24). The resulting vector pair (θ,ϕ) is stored as an updated R-T characteristic table in the R-T characteristic table storage section 62M (Step S25). Further, the R-T characteristic table calculating module 62 causes the notifying unit 18 to notify the operator that the marine vessel maneuvering characteristic has been updated (the R-T characteristic table has been updated) (Step S26).

When the remote control lever 8*a* is thereafter operated to set the shift position at the forward drive position or at the reverse drive position, the target throttle opening degree calculating module 61 sets the target throttle opening degree according to the new R-T characteristic table stored in the R-T characteristic table storage section 62M. Thus, the output of the engine 39 (engine speed) is controlled according to the target R-N characteristic set by the operator.

Figure 23:
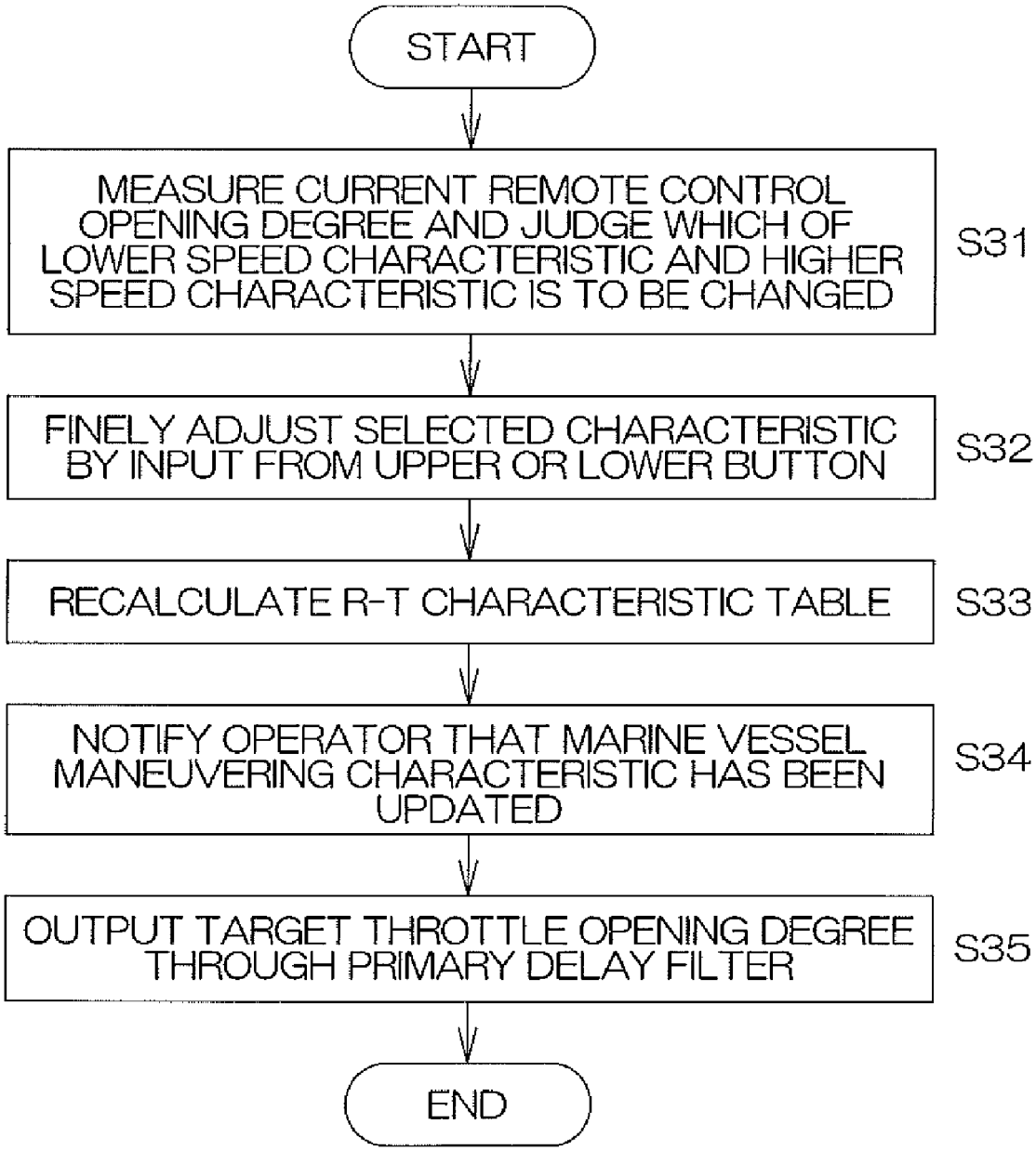
FIG. 23 is a flow chart for explaining a process to be performed for setting the target characteristic curve when the marine vessel is in a traveling state.

FIG. 23 is a flow chart for explaining a process to be performed for setting the target R-N characteristic when the marine vessel is in the traveling state (when the shift position is set at a non-neutral position, i.e., at the forward drive position or at the reverse drive position). The target characteristic setting module 67 judges, based on an output from the throttle operational section 8 and a currently used target R-N characteristic (target R-N characteristic table), whether a current remote control opening degree is in the higher speed characteristic region or in the lower speed characteristic region (Step S31).

Figure 24:
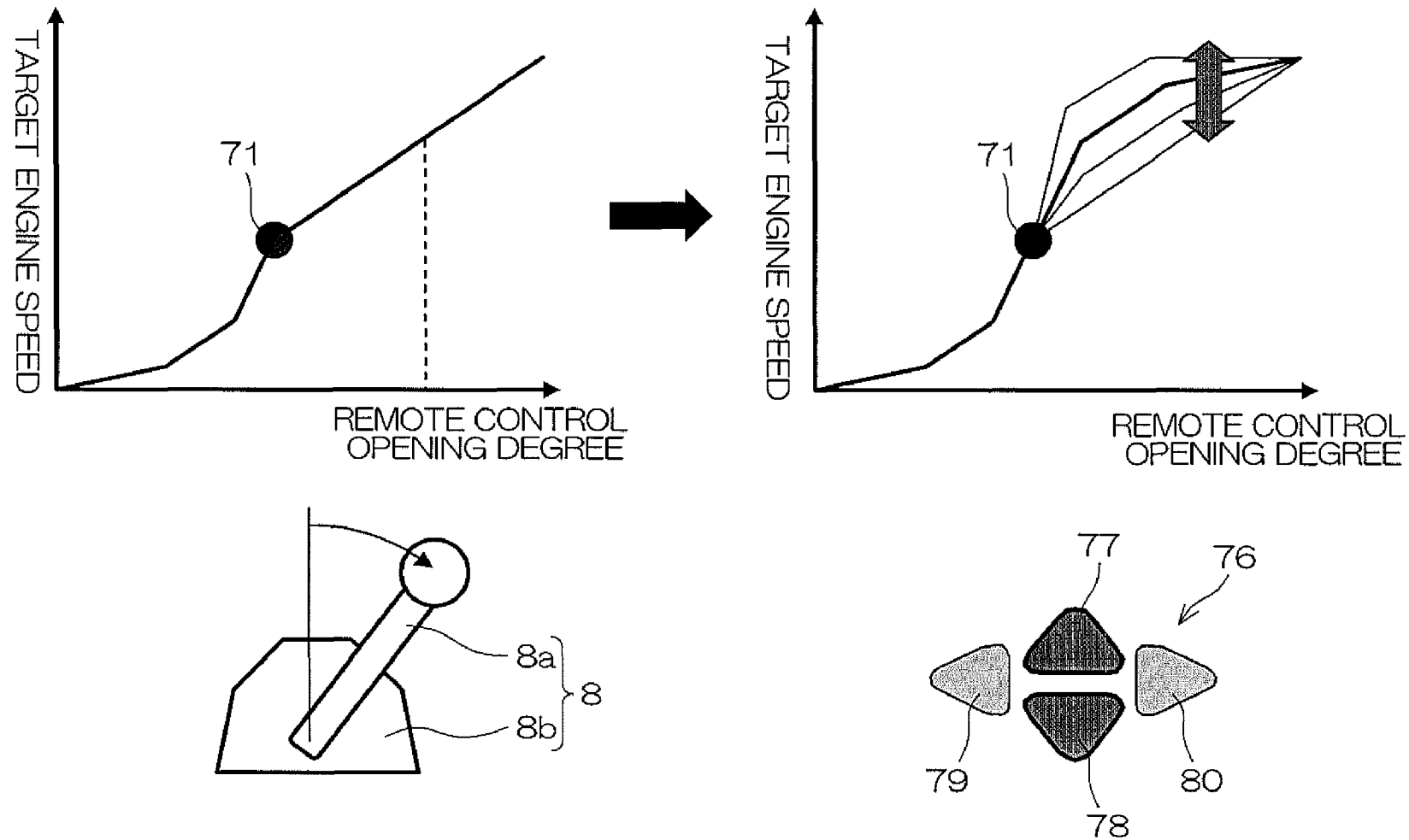
FIG. 24 is a diagram for explaining a process for finely adjusting the target characteristic curve with the use of a remote control lever and a cross button.

When the operator desires to finely adjust the target characteristic to cause the target characteristic curve to project upward, as shown in FIG. 24 (which shows an operation for changing the higher speed characteristic by way of example), the operator presses the upper button 77 of the cross button 76 without moving the remote control lever 8*a*. Every time the upper button 77 is pressed, the upwardly projecting degree of the lower speed characteristic curve portion or the higher speed characteristic curve portion is increased depending on the result of the judgment in Step S31. Thus, a new target characteristic is provided, and stored in the target R-N characteristic table storage section 67M (Step S32). The R-T characteristic table calculating module 62 recalculates the R-T characteristic table according to the new target characteristic, and stores the recalculated R-T characteristic table in the R-T characteristic table storage section 62M (Step S33).

When the operator desires to finely adjust the target characteristic to cause the target characteristic curve to project downward, the operator presses the lower button 78 of the cross button 76 without moving the remote control lever 8*a*. Every time the lower button 78 is pressed, the downwardly projecting degree of the lower speed characteristic curve portion or the higher speed characteristic curve portion is increased depending on the result of the judgment in Step S31. Thus, a new target characteristic is provided, and stored in the target R-N characteristic table storage section 67M (Step S32). The R-T characteristic table calculating module 62 recalculates the R-T characteristic table according to the new target characteristic, and stores the recalculated R-T characteristic table in the R-T characteristic table storage section 62M (Step S33).

When the marine vessel is in the traveling state, the throttle operational section 8 doubles as the to-be-changed portion specifying unit for selecting one of the lower speed characteristic curve portion and the higher speed characteristic curve portion on which a shape changing operation is performed.

After the recalculated R-T characteristic table is stored in the storage section 62M, the R-T characteristic table calculating module 62 causes the notifying unit 18 to notify the operator that the marine vessel maneuvering characteristic has been updated (the R-T characteristic table has been updated) (Step S34).

The target throttle opening degree calculating module 61 calculates the target throttle opening degree according to the finely adjusted R-T characteristic table. The target throttle opening degree is applied to the outboard motor ECU 11 via the primary delay filter 68 (Step S35).

Thus, the operator can finely adjust the target characteristic while checking the behavior of the engine 39 responsive to the operation of the remote control lever 8*a* during the travel of the marine vessel 1.

If the throttle opening degree is suddenly changed due to the change in the R-T characteristic table during the travel of the marine vessel, the engine output is suddenly changed, thereby causing an unnatural feeling in the crew or passengers. In order to prevent the sudden change in the throttle opening degree, the primary delay filter 68 is provided for minimizing a stepped change in the target throttle opening degree in this preferred embodiment. Therefore, the target throttle opening degree passed through the primary delay filter 68 is output as the final target throttle opening degree to the outboard motor ECU 11. The primary delay filter 68 is operative only for a predetermined period (e.g., about 5 seconds) which is required for minimizing the influence of the stepped change occurring in the target characteristic due to the recalculation during the travel of the marine vessel.

Although the primary delay filter 68 is preferably used in this preferred embodiment, the stepped change in the target throttle opening degree may be minimized in other ways. For example, the throttle opening degree may be gradually changed from the current level to the target level through linear interpolation based on the current throttle opening degree and the recalculated target throttle opening degree.

Figure 25:
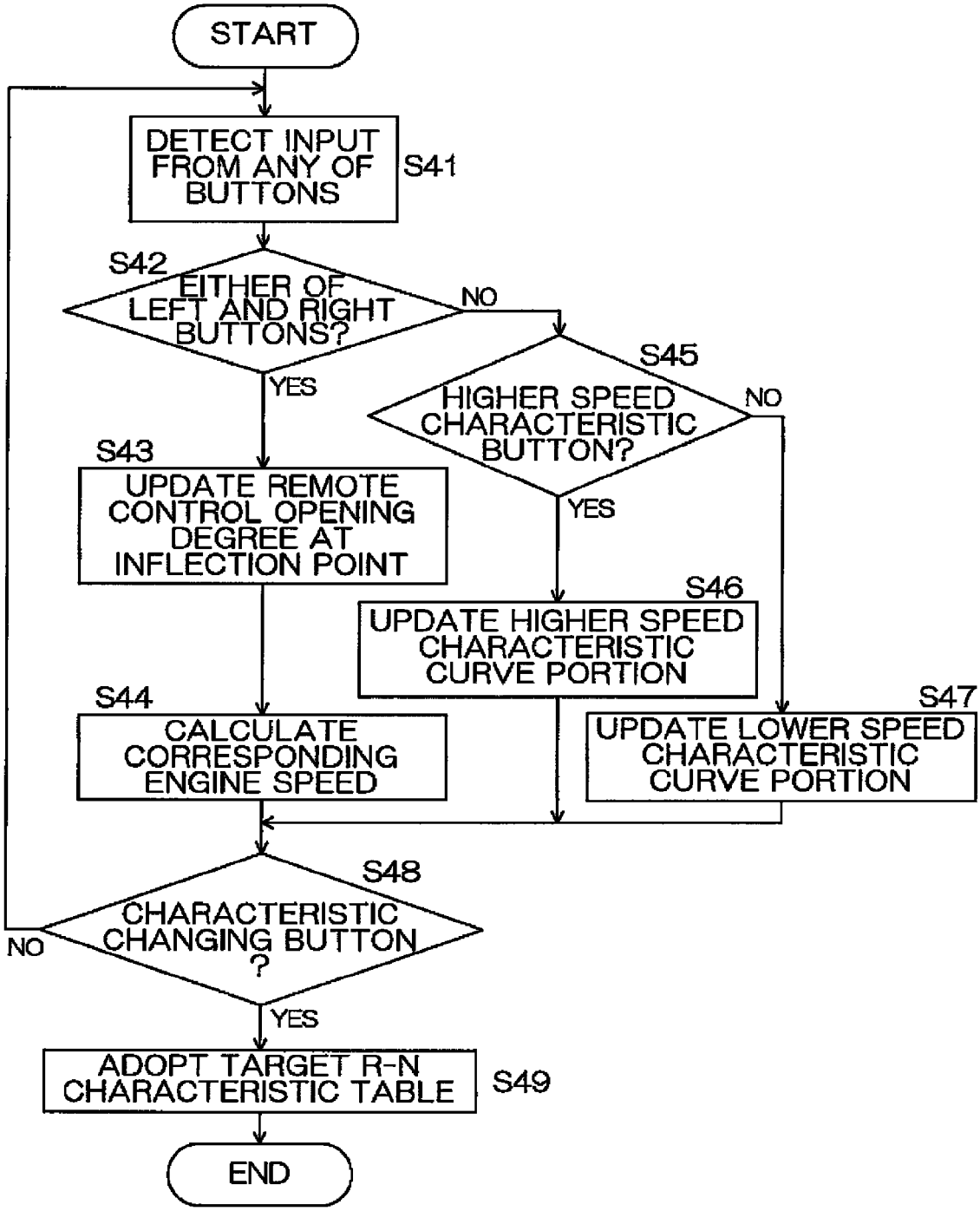
FIG. 25 is a flow chart for explaining an exemplary process for modifying a target characteristic table with the use of the cross button.

FIG. 25 is a flow chart for explaining an exemplary process to be performed by the target characteristic setting module 67 for changing the target R-N characteristic table by means of the cross button 76. The target characteristic setting module 67 monitors an input from any of the buttons (Step S41). If an input from any of the buttons is detected, the target characteristic setting module 67 judges whether either of the left and right buttons 79, 80 of the cross button 76 is pressed (Step S42). If either of the left and right buttons 79, 80 is pressed, the remote control opening degree $\theta_p$ at the inflection point is updated based on the following expression (7) (Step S43) to provide a new remote control opening degree $\theta_{pNEW}$. In the expression (7), $\Delta\theta$ is a change amount (a constant value in this preferred embodiment) observed when either of the left and right buttons 79, 80 is pressed once. For example, $\Delta\theta$ may be +5% when the right button 80 is pressed, and may be −5% when the left button 79 is pressed.

$$\theta_{pNEW}=\theta_p+\Delta\theta \tag{7}$$

The target characteristic setting module 67 further determines an engine speed $N_p$ for the remote control opening degree $\theta_p$ at the updated inflection point from the aforementioned expression (5) (Step S44). Thus, the updated inflection point is defined.

If neither of the left and right buttons 79, 80 is pressed in step S42, it is considered that either of the upper and lower buttons 77, 78 is pressed. In this case, the target characteristic setting module 67 further judges whether the higher speed characteristic button 85 is pressed (Step S45).

If the higher speed characteristic button 85 is pressed, the setting parameter $k_h$ in the expression (6) is updated to a new parameter $k_{hNEW}$ obtained from the following expression (8). Thus, the higher speed characteristic curve portion is updated (Step S46).

$$k_{hNEW}=k_h+\Delta k_h \tag{8}$$

wherein $\Delta k_h$ is a change amount (a constant value in this preferred embodiment) observed when either of the upper and lower buttons 77, 78 is pressed once. Where $k_h \leqq 1$, for example, $\Delta k_h$ may be set to −0.1 when the upper button 77 is pressed, and may be set to +0.1 when the lower button 78 is pressed. Further, where $k_h>1$, $\Delta k_h$ may be set to −1 when the upper button 77 is pressed, and may be set to +1 when the lower button 78 is pressed.

If the higher speed characteristic button 85 is not pressed, the setting parameter $k_l$ in the expression (6) is updated to a new parameter $k_{lNEW}$ obtained from the following expression (9). Thus, the lower speed characteristic curve portion is updated (Step S47).

$$k_{lNEW}=k_l+\Delta k_l \tag{9}$$

wherein $\Delta k_l$ is a change amount (a constant value in this preferred embodiment) observed when either of the upper and lower buttons 77, 78 is pressed once. Where $k_l \leqq 1$, for example, $\Delta k_l$ may be set to −0.1 when the upper button 77 is pressed, and may be set to +0.1 when the lower button 78 is pressed. Further, where $k_l>1$, $\Delta k_l$ may be set to −1 when the upper button 77 is pressed, and may be set to +1 when the lower button 78 is pressed.

Further, the target characteristic setting module 67 judges whether the characteristic changing button 84 is pressed (Step S48). If the characteristic changing button 84 is not pressed, a process sequence from Step S41 is repeated to receive an input from the operator for changing the position of the inflection point and/or for updating the higher speed characteristic curve portion and/or the lower speed characteristic curve portion.

If the characteristic changing button 84 is pressed, the target characteristic setting module 67 adopts the thus set characteristic as the target R-N characteristic table (Step S49), and stores the target R-N characteristic table in the target R-N characteristic table storage section 67M. Then, the target characteristic setting process ends.

Next, a process to be performed by the target characteristic setting module 67 based on an input from the touch panel 75 will be described. An input operation is performed on the touch panel 75 by directly touching the screen of the display device 15 by the touch pen 83. However, the input operation may be performed with the use of a pointing device such as a mouse or other suitable input device.

Figure 26:
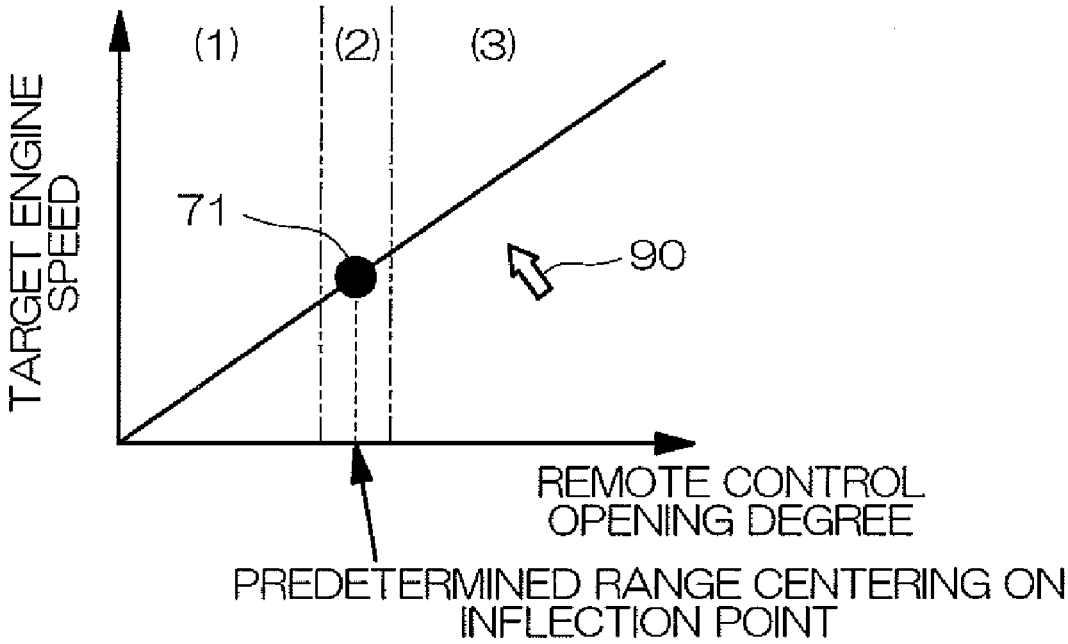
FIG. 26 is a diagram for explaining operating regions to be operated when the target characteristic table is modified on a touch panel.

As shown in FIG. 26, the display screen of the display device 15 is preferably divided into the following three regions: an inflection point operating region (2) defined by a predetermined range centering on the remote control opening degree $\theta_p$ at the inflection point; a lower speed characteristic operating region (1) located on a left side of the inflection point operating region; and a higher speed characteristic operating region (3) located on a right side of the inflection point operating region. More specifically, these regions are defined as follows:

Lower speed characteristic operating region (1)

$$0 \leqq \theta < \theta_p - 5$$

Inflection point operating region (2)

$$\theta_p-5 \leqq \theta \leqq \theta_p+5$$

Higher speed characteristic operating region (3)

$$\theta_p+5 \leqq \theta \leqq 100$$

Figure 27:
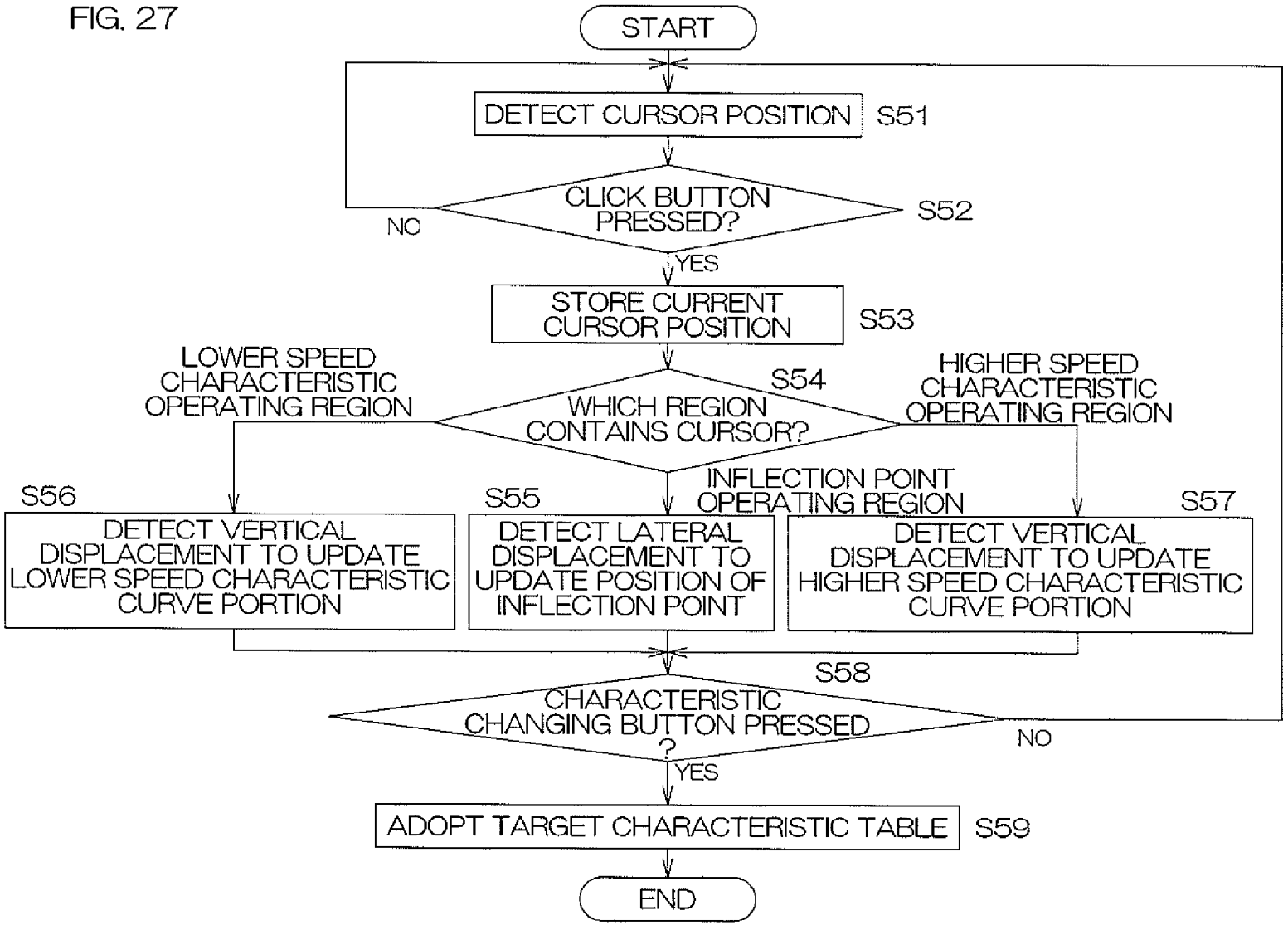
FIG. 27 is a flow chart for explaining an exemplary process for modifying the target characteristic table on the touch panel.

FIG. 27 is a flow chart for explaining an exemplary process to be performed by the target characteristic setting module 67 based on the input from the touch panel 75. First, the target characteristic setting module 67 detects the position of a cursor 90 (see FIG. 26) displayed on the screen of the display device 15 (a point currently touched or finally touched by the touch pen 83) (Step S51). Further, the target characteristic setting module 67 judges whether the click button 83A of the touch pen 83 is pressed for the dragging operation (Step S52). The dragging operation is such that the position of the touch pen 83 is changed on the screen with the click button 83A being pressed. If the click button 83A is not pressed, the process returns to Step S51. If the click button 83A is pressed, the current position of the cursor 90 on the screen is stored in a memory (not shown) (Step S53).

When the current position of the cursor 90 is stored, the target characteristic setting module 67 determines which of the three regions (1), (2) and (3), i.e., the lower speed characteristic operating region (1), the inflection point operating region (2) and the higher speed characteristic operating region (3), contains the cursor 90 (Step S54). If the cursor 90 is present in the inflection point operating region (2), the target characteristic setting module 67 performs an inflection point position updating process (Step S55). If the cursor 90 is present in the lower speed characteristic operating region (1), the target characteristic setting module 67 performs a lower speed characteristic curve portion updating process (Step S56). If the cursor 90 is present in the higher speed characteristic operating region (3), the target characteristic setting module 67 performs a higher speed characteristic curve portion updating process (Step S57).

In the inflection point position updating process (Step S55), if the cursor 90 is moved from the cursor position stored in the memory by the dragging operation with the touch pen 83, the target characteristic setting module 67 detects a lateral displacement of the cursor 90. That is, the target characteristic setting module 67 neglects a vertical displacement of the cursor 90. Then, the target characteristic setting module 67 updates the remote control opening degree $\theta_p$ at the inflection point 71 according to the detected displacement, and calculates a corresponding engine speed $N_p$ from the expression (5). Thus, the position of the inflection point 71 is changed.

In the lower speed characteristic curve portion updating process (Step S56), if the cursor 90 is moved from the cursor position stored in the memory by the dragging operation with the touch pen 83, the target characteristic setting module 67 detects a vertical displacement of the cursor 90. That is, the target characteristic setting module 67 neglects a lateral displacement of the cursor 90. Then, the target characteristic setting module 67 updates the parameter $k_l$ according to the detected displacement. Thus, the shape of the lower speed characteristic curve portion is changed.

In the higher speed characteristic curve portion updating process (Step S57), similarly, if the cursor 90 is moved from the cursor position stored in the memory by the dragging operation with the touch pen 83, the target characteristic setting module 67 detects a vertical displacement of the cursor 90. That is, the target characteristic setting module 67 neglects a lateral displacement of the cursor 90. Then, the target characteristic setting module 67 updates the parameter $k_h$ according to the detected displacement. Thus, the shape of the higher speed characteristic curve portion is changed.

After the inflection point position updating process (Step S55), the lower speed characteristic curve portion updating process (Step S56) or the higher speed characteristic curve portion updating process (Step S57), the target characteristic setting module 67 judges whether the characteristic changing button 84 is pressed (Step S58). If the characteristic changing button 84 is not pressed, a process sequence from Step S51 is repeated. Thus, the operator continues to change the target R-N characteristic table. On the other hand, if the characteristic changing button 84 is pressed, the target characteristic setting module 67 adopts the target characteristic table thus updated, and stores the target characteristic table in the target R-N characteristic table storage section 67M (Step S59). The R-T characteristic table calculating module 62 calculates the R-T characteristic table according to the updated target R-N characteristic table.

In this preferred embodiment, the operator can easily set the target engine speed characteristic with respect to the remote control opening degree by thus operating the touch panel 75 and/or the cross button 76 in an intuitive manner. Further, the target characteristic can be easily updated by performing substantially the same operation. Thus, the change in the engine speed with respect to the operation of the remote control lever 8*a* can be adapted for the operator's preference. As a result, the marine vessel 1 can be easily and properly maneuvered irrespective of the level of the skill of the operator.

A plurality of target R-N characteristics set by the target characteristic setting module 67 may be registered in the target R-N characteristic table storage section 67M. In this case, one of the registered target characteristics is selected to be read out according to the state of the marine vessel 1 or the operator's preference, and the selected target characteristic is used for maneuvering the marine vessel 1.

Figure 28:
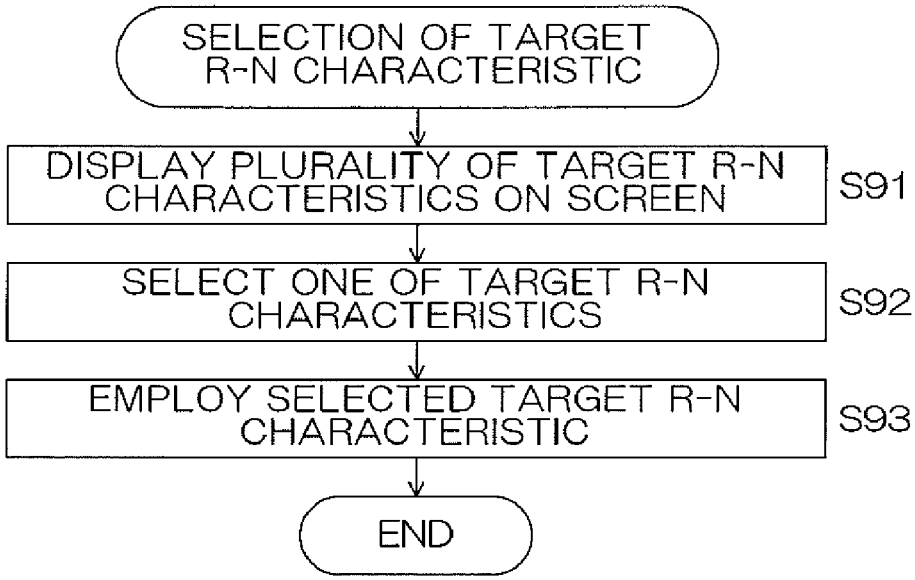
FIG. 28 is a flow chart for explaining an exemplary process for setting the target characteristic.

More specifically, as shown in FIG. 28, the target R-N characteristics stored in the target R-N characteristic table storage section 67M are read out in response to a predetermined operation performed on the input device 14, and displayed on the display device 15 by the target characteristic setting module 67 (Step S91). The operator selects one of the target R-N characteristics by operating the input device 14 (selecting unit) (Step S92). The selected target R-N characteristic is used for computation in the R-T characteristic table calculating module 62 (Step S93).

R-T characteristics previously calculated for the respective target R-N characteristics stored in the target R-N characteristic table storage section 67M are preferably stored in the R-T characteristic table storage section 62M. In this case, when one of the target R-N characteristics is selected by operating the input device 14, the R-T characteristic table calculating module 62 selects a corresponding one of the R-T characteristic tables. The target throttle opening degree calculating module 61 performs the computation based on the selected R-T characteristic table.

Figure 29:
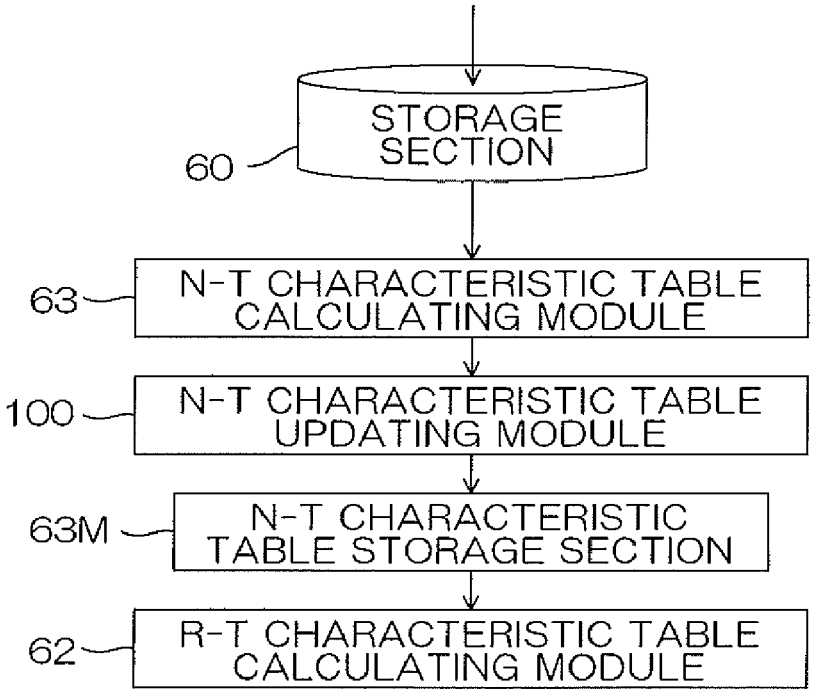
FIG. 29 is a block diagram for explaining an arrangement according to a second preferred embodiment of the present invention.

FIG. 29 is a block diagram for explaining an arrangement according to a second preferred embodiment of the present invention. When a required amount of data is accumulated in the storage section 60 by the data collecting section 64, the N-T characteristic table calculating module 63 calculates a new N-T characteristic table. In the preferred embodiment described above, the new N-T characteristic table is stored as it is in the N-T characteristic table storage section 63M, and is preferably used for the computation of the R-T characteristic table. In this preferred embodiment, on the contrary, the N-T characteristic table to be used for the computation of the R-T characteristic table is conditionally updated by an N-T characteristic table updating module 100.

Figure 30:
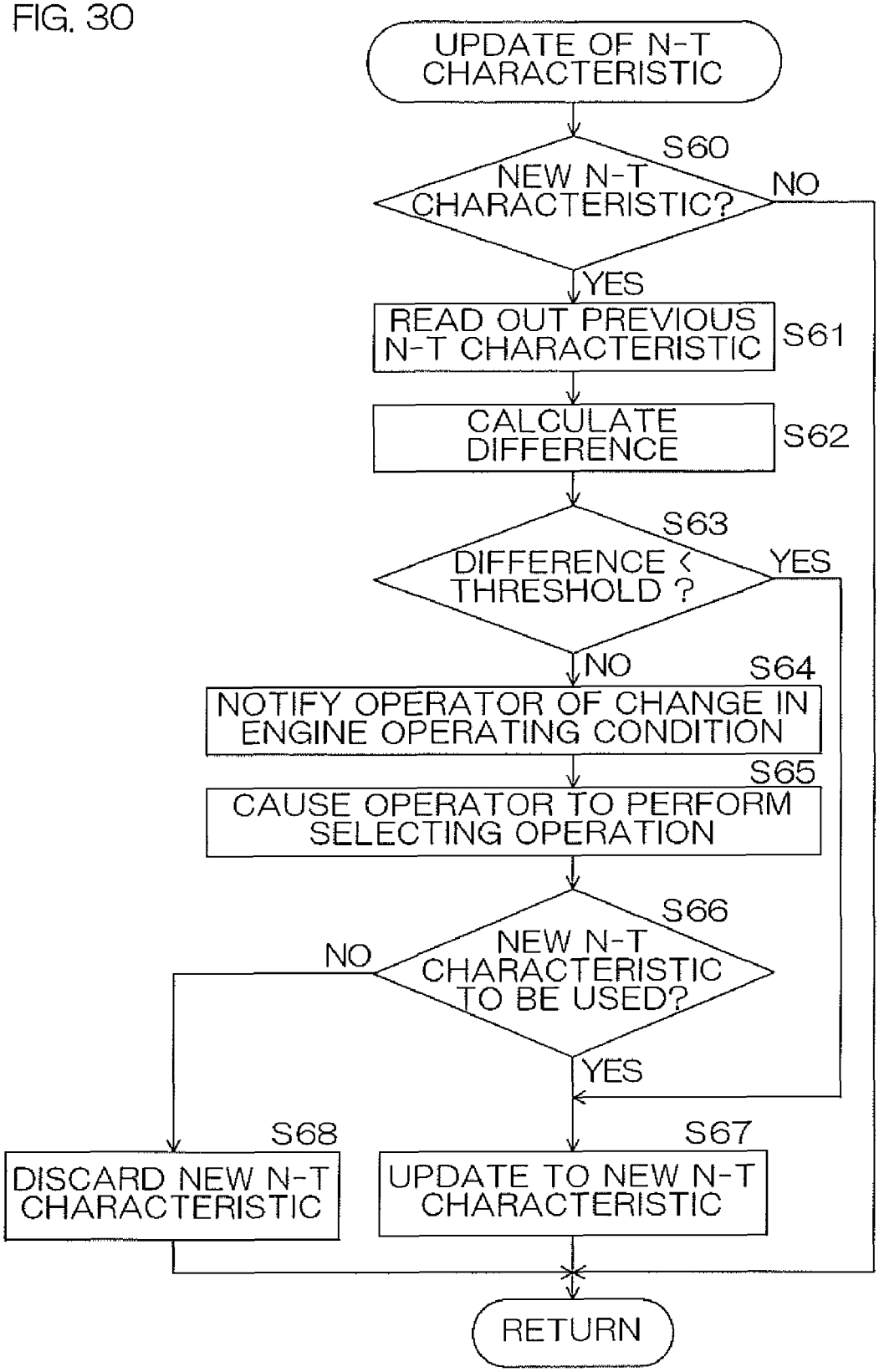
FIG. 30 is a flow chart for explaining an exemplary process for updating an N-T characteristic table.

FIG. 30 is a flow chart for explaining a process to be performed by the N-T characteristic table updating module 100. When the new N-T characteristic is calculated by the N-T characteristic table calculating module 63 (YES in Step S60), the N-T characteristic table updating module 100 reads out the previous N-T characteristic stored in the N-T characteristic table storage section 63M (Step S61). The N-T characteristic table updating module 100 further calculates a difference between the new N-T characteristic and the previous N-T characteristic, functioning as a difference calculating unit (Step S62). The calculation of the difference is achieved, for example, by calculating a distance between engine speed vectors N of the new and previous N-T characteristics. Alternatively, the calculation of the difference may be achieved by calculating differences between corresponding components of the engine speed vectors N of the new and previous N-T characteristics, and determining the maximum one as the difference.

The N-T characteristic table updating module 100 judges whether the calculated difference is smaller than a predetermined threshold, functioning as a difference judging unit (Step S63). If the difference is smaller than the predetermined threshold, the N-T characteristic table updating module 100 unconditionally writes the new N-T characteristic in the N-T characteristic table storage section 63M (Step S67). Thus, the N-T characteristic table to be used for the calculation of the R-T characteristic table is updated to the new N-T characteristic.

On the other hand, if the calculated difference is not smaller than the threshold, the N-T characteristic table updating module 100 suspends the update of the N-T characteristic table, functioning as an update suspending unit (NO in Step S63). Then, the N-T characteristic table updating module 100 notifies the operator that the update of the N-T characteristic table is suspended, functioning as a notifying unit (Step S64). The notification may be provided, for example, by displaying a predetermined message on the display device 15. An example of the message is "The engine operating condition has been updated. Is the updated operating condition to be used?" Alternatively, an alarm or an audible message may be provided from a speaker to the operator.

In response to the notification, the operator operates the input device 14 (characteristic update commanding unit) to decide whether to use the new N-T characteristic (Step S65). More specifically, for example, buttons to be selectively pressed for determining whether to update the previous N-T characteristic to the new N-T characteristic or to continue to use the previous N-T characteristic are displayed on the display device 15. The operator selects the new N-T characteristic or the previous N-T characteristic by operating one of these buttons.

If the new N-T characteristic is to be used (YES in Step S66), the N-T characteristic table updating module 100 writes the new N-T characteristic in the N-T characteristic table storage section 63M, functioning as an updating unit (Step S67). Thus, the N-T characteristic to be used for the calculation of the R-T characteristic is updated.

If the previous N-T characteristic is to be used (NO in Step S66), the N-T characteristic table updating module 100 discards the new N-T characteristic (Step S68).

Where the number of crew members and/or passengers or the weight of the cargo is temporarily changed, for example, the marine vessel travels in a state different from an ordinary traveling state. In this case, the engine speed characteristic with respect to the remote control opening degree is likely to be drastically changed as compared with the previous characteristic. If the N-T characteristic was automatically changed in this case, it would be difficult to control the marine vessel as desired when the traveling state is restored to the ordinary traveling state. This would cause an unnatural feeling in the operator.

In this preferred embodiment, therefore, the N-T characteristic is updated on approval by the operator, if the newly calculated N-T characteristic is significantly changed from the previous N-T characteristic.

As described above, the N-T characteristic is defined by the representative data determined based on the learning data excluding the abnormal data samples attributable to the overrev of the engine 39 and other causes. Therefore, the difference between the new N-T characteristic and the previous N-T characteristic is also accurately determined. Thus, the N-T characteristic can be properly updated.

Figure 31:
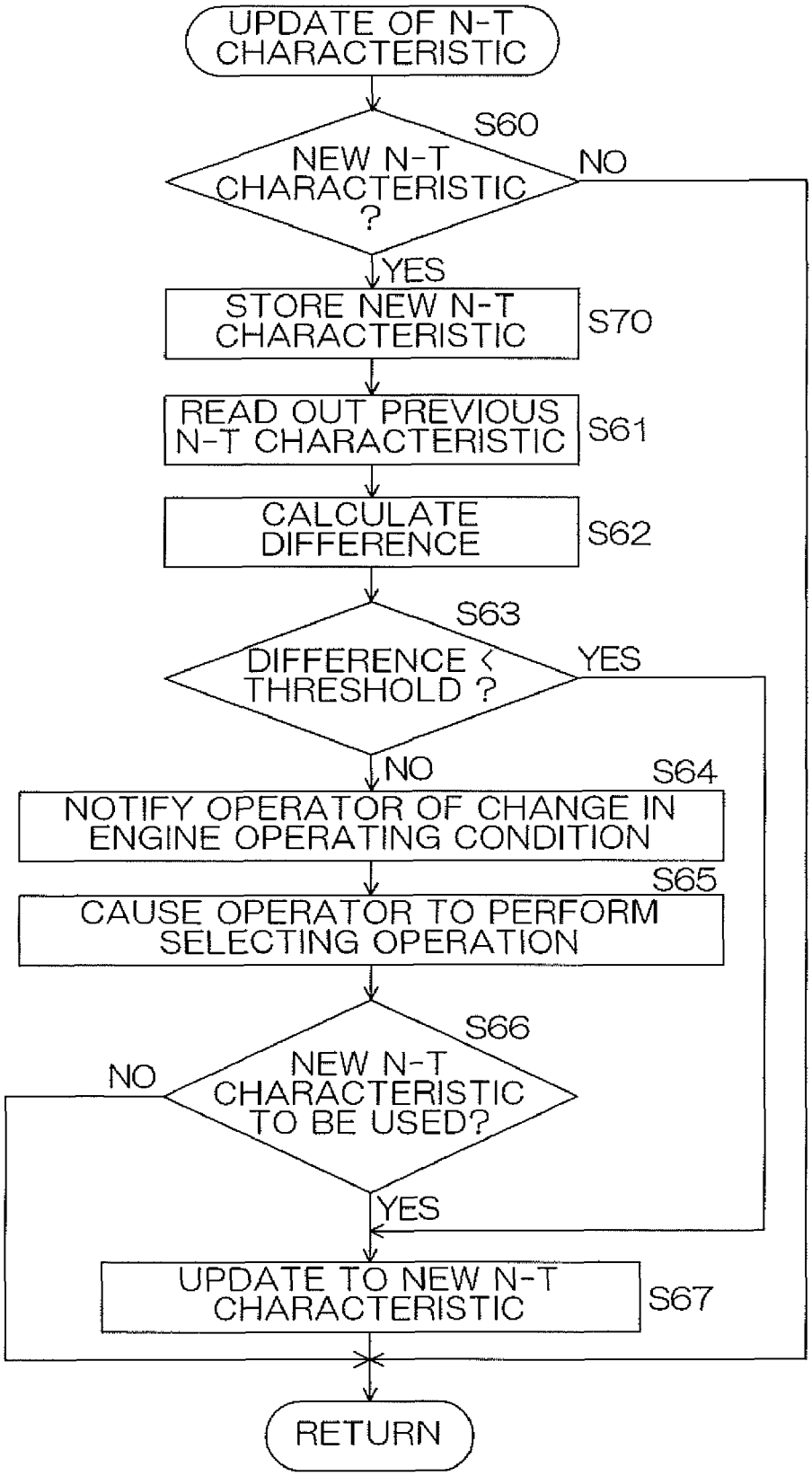
FIG. 31 is a flow chart for explaining another exemplary process for updating the N-T characteristic table.

FIG. 31 is a flow chart for explaining another exemplary process to be performed by the N-T characteristic table updating module 100. In FIG. 31, steps corresponding to those shown in FIG. 30 will be indicated by the same step numbers. This process is used when a plurality of N-T characteristics are stored in the N-T characteristic table storage section 63M.

When the new N-T characteristic is calculated by the N-T characteristic table calculating module 63 (YES in Step S60), the N-T characteristic table updating module 100 stores the new N-T characteristic in the N-T characteristic table storage section 63M (Step S70). At this time, however, the new N-T characteristic is not necessarily used for the calculation of the R-T characteristic.

If the difference between the new N-T characteristic and the previous N-T characteristic is smaller (YES in Step S63) or if the operator decides to use the new N-T characteristic (YES in Step S66), the new N-T characteristic is used (YES in Step S67). In this process, the N-T characteristic table updating module 100 selects the new N-T characteristic from the N-T characteristics stored in the N-T characteristic table storage section 63M for the calculation of the R-T characteristic.

Even if the new N-T characteristic is not used (NO in Step S66), it is not necessary to discard the new N-T characteristic.

Figure 32:
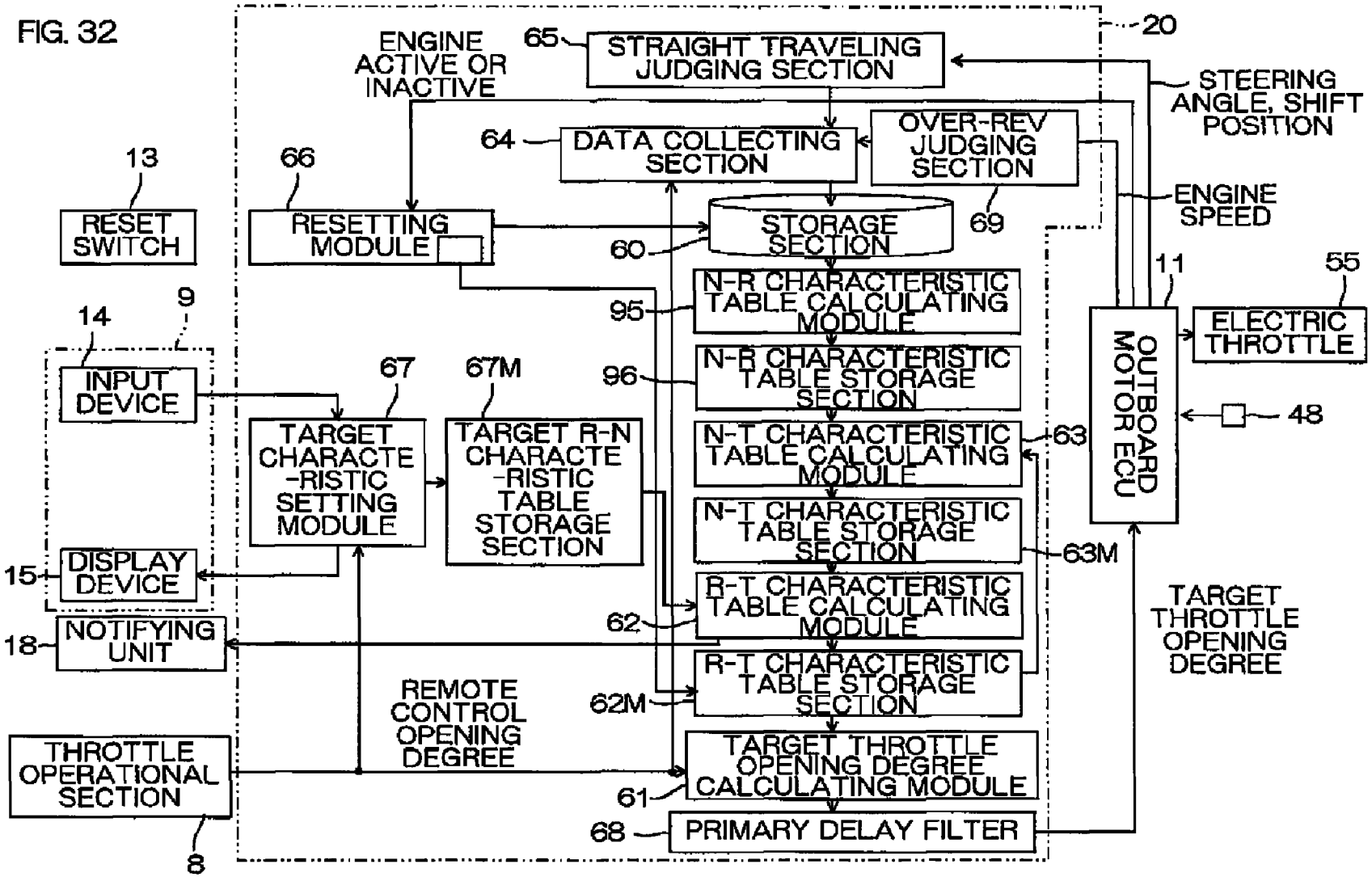
FIG. 32 is a block diagram for explaining the construction of a marine vessel running controlling apparatus according to a third preferred embodiment of the present invention.
Figure 33:
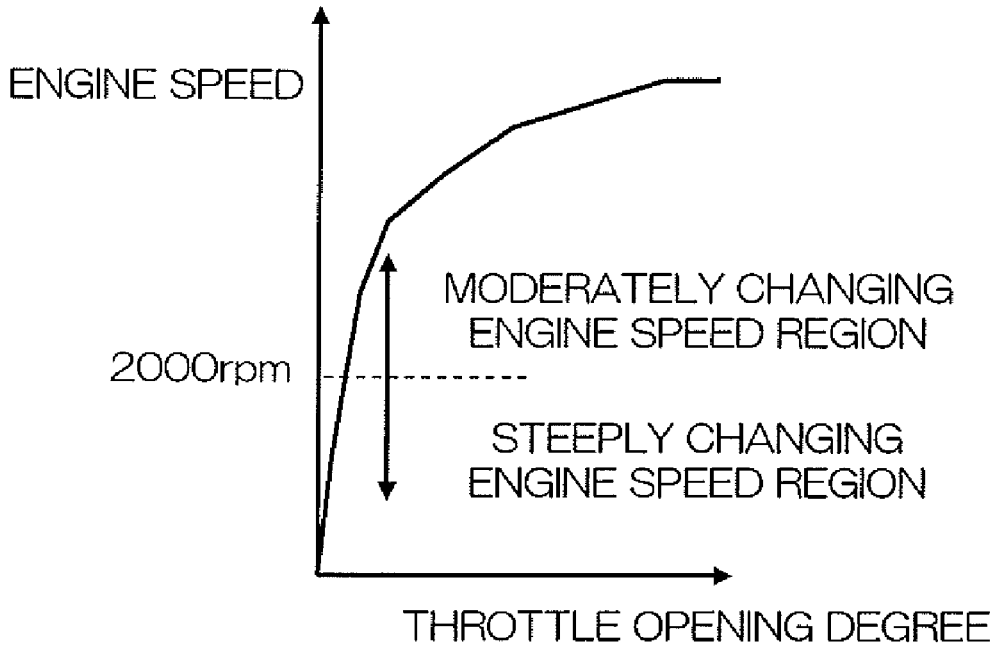
FIG. 33 is a characteristic diagram for explaining a nonlinear relationship between an engine speed and a throttle opening degree.
Figure 34:
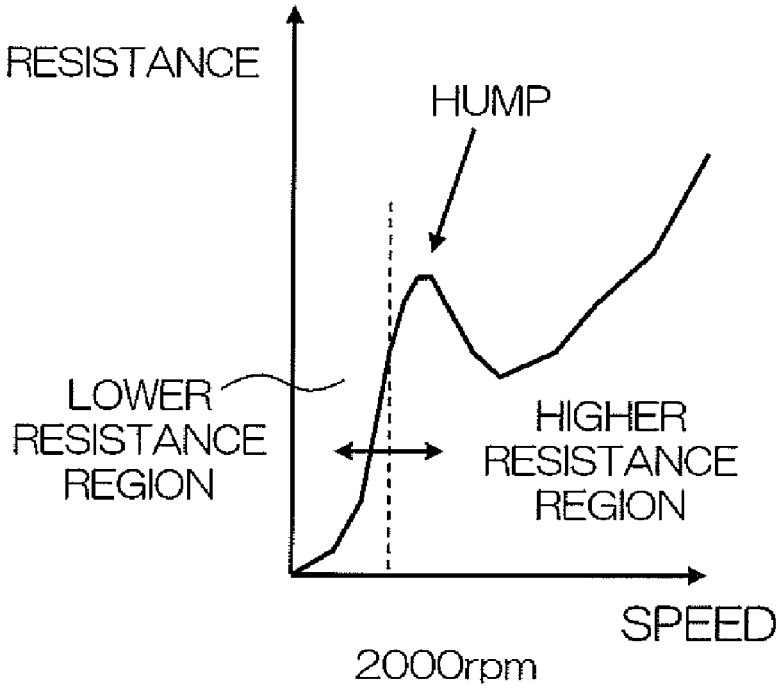
FIG. 34 is a characteristic diagram for explaining a relationship between the speed of a marine vessel and a resistance received by the marine vessel.

FIG. 32 is a block diagram for explaining the construction of a marine vessel running controlling apparatus according to a third preferred embodiment of the present invention. In FIG. 32, components corresponding to those shown in FIG. 3 will be denoted by the same reference characters as in FIG. 3. In this preferred embodiment, when the straight traveling judging section 65 judges that the marine vessel is in the straight traveling state, the data collecting section 64 collects an engine speed N from the outboard motor ECU 11 and a remote control opening degree θ output from the throttle operational section 8, and stores the engine speed N and the remote control opening degree θ as learning data in the storage section 60. An N-R characteristic table calculating module 95 correlates the engine speed N and the remote control opening degree θ stored in the storage section 60 to calculate an engine speed-remote control opening degree characteristic (N-R characteristic) table. The N-R characteristic table which is based on actual measurement data of the N-R characteristic is stored in an N-R characteristic table storage section 96.

The N-T characteristic table calculating module 63 reads out the current R-T characteristic table from the R-T characteristic table storage section 62M, and calculates an N-T characteristic table based on the current R-T characteristic table and the N-R characteristic table based on the actual measurement. Then, the N-T characteristic table calculating module 63 stores the N-T characteristic table in the N-T characteristic table storage section 63M.

The other arrangements and processes are preferably the same as those in the first preferred embodiment.

In this preferred embodiment, the engine speed N and the remote control opening degree θ are measured as the learning data, and a desired target R-N characteristic is provided based on the learning data. In this preferred embodiment, the data collecting section 64, the N-R characteristic table calculating module 95 and the like define an engine characteristic measuring unit.

While the three preferred embodiments of the present invention have thus been described, the present invention may be embodied in other ways. In the preferred embodiments described above, the marine vessel 1 preferably includes the single outboard motor 10, but the present invention is applicable, for example, to a marine vessel including a plurality of outboard motors (e.g., two outboard motors) provided on the stern 3 thereof.

In the first and second preferred embodiments described above, the R-T characteristic table is preferably calculated if measurement values are acquired for the respective zones obtained by dividing the entire throttle opening degree range (Step S9 in FIG. 4). Alternatively, the calculation of the R-T characteristic table may be permitted if measurement values are acquired for the zone $M_1$ corresponding to the throttle fully closed state (with a throttle opening degree of 0%) and the zone $M_7$ corresponding to the throttle fully open state (with a throttle opening degree of 100%). Thus, the R-T characteristic table, which roughly conforms to the target R-N characteristic, can be quickly provided. The R-T characteristic is modified by thereafter acquiring measurement data for the other zones. Thus, the operation amount-engine speed characteristic can be converged on the target R-N characteristic with high accuracy.

Further, the third preferred embodiment may be modified in substantially the same manner as described with reference to FIGS. 28 to 31. Where the third preferred embodiment is modified in the same manner as the second preferred embodiment, the N-R characteristic instead of the N-T characteristic may be conditionally updated.

In the preferred embodiments described above, the engine speed characteristic is preferably measured as the engine output characteristic, but the measurement of the engine output characteristic may be achieved in any other way. For example, a speed sensor for measuring the traveling speed of the marine vessel 1 may be used for indirectly measuring the engine output characteristic. More specifically, the acceleration characteristic of the marine vessel 1 may be determined based on the speed of the marine vessel 1 measured by the speed sensor, and used as the engine output characteristic.

Where the abnormal data samples including those attributable to the over-rev of the engine 39 are eliminated through the statistic analysis (using the median, the trimmed mean and/or the standard deviation) after the acquisition of the learning data, the over-rev judging section 69 may be obviated.

Instead of the median, the trimmed mean and/or the standard deviation, a geometric mean (the Nth root of the product of N data samples of the learning data) or a harmonic mean (the reciprocal of the average of the reciprocals of the respective data samples of the leaning data) may be used as the representative data.

In the preferred embodiments described above, the learning data preferably is collected during the travel of the marine vessel, and the R-T characteristic table is preferably prepared based on the learning data. Alternatively, a plurality of leaning data sets collected during travel of the marine vessel in various traveling states may be preliminarily accumulated in the storage section 60. The various traveling states include traveling states observed when different numbers of crew members and/or passengers are onboard, traveling states observed when different amounts of cargo are onboard, and traveling states observed under different conditions which differently affect the behavior of the marine vessel. In this case, it is preferred that one of the traveling states can be selected by operating the control console 6 (e.g., by operating the input device 14). The N-T characteristic table calculating module 63 (see FIG. 3) or the N-R characteristic table calculating module 95 (see FIG. 32) reads a learning data set corresponding to the selected traveling state from the storage section 60. Thus, an R-T characteristic map is provided for the selected traveling state. Therefore, a marine vessel maneuvering characteristic suitable for the traveling state can be provided without the collection of the learning data.

In the processes shown in FIGS. 30 and 31, it is preferred that when the new N-T characteristic table is provided, the difference between the new N-T characteristic table and the previous N-T characteristic table is determined and, if the difference is not smaller than the threshold, the update of the N-T characteristic table is suspended. This idea may be extensively applied to other control information. More specifically, a difference between the new R-T characteristic table and the previous R-T characteristic table is determined when the R-T characteristic table stored in the R-T characteristic table storage section 62M is to be updated. If the difference is smaller than a predetermined threshold, the R-T characteristic table may be immediately updated and, if the difference is not smaller than the threshold, the update may be suspended. Further, the operator may be permitted to decide whether to affect the update.

It should be noted that update of data may be performed by overwriting previous data with new data, or may be performed by retaining the previous data in a storage area of a storage media while writing the new data into another storage area of the storage media.

While the present invention has been described in detail by way of the preferred embodiments thereof, it should be understood that these preferred embodiments are merely illustrative of the technical principles of the present invention but not limitative of the invention. The spirit and scope of the present invention are to be limited only by the appended claims.

This application corresponds to Japanese Patent Application No. 2007-143842 filed in the Japanese Patent Office on May 30, 2007, the disclosure of which is incorporated herein by reference.

What is claimed is:

1. A marine vessel running controlling apparatus for a marine vessel which includes a propulsive force generating unit having an engine with an electric throttle as a drive source to generate a propulsive force to propel a hull of the marine vessel, the marine vessel running controlling apparatus comprising:

an operational unit to be operated by an operator of the marine vessel to control the propulsive force;

a control unit arranged to acquire a normal data sample by eliminating an abnormal data sample from actual data acquired during travel of the marine vessel, and update control information related to an opening degree of the electric throttle with respect to an operation amount of the operational unit based on the normal data sample; and an abnormal drive judging unit arranged to judge whether the engine is in an abnormal drive state; wherein the control unit includes an actual data eliminating unit arranged to eliminate an actual data sample acquired in a period during which the abnormal drive judging unit judges that the engine is in the abnormal drive state.

2. A marine vessel running controlling apparatus for a marine vessel which includes a propulsive force generating unit having an engine with an electric throttle as a drive source to generate a propulsive force to propel a hull of the marine vessel, the marine vessel running controlling apparatus comprising:

an operational unit to be operated by an operator of the marine vessel to control the propulsive force; and a control unit arranged to acquire a normal data sample by eliminating an abnormal data sample from actual data acquired during travel of the marine vessel, and update control information related to an opening degree of the electric throttle with respect to an operation amount of the operational unit based on the normal data sample; wherein the control unit includes a median computing unit arranged to compute a median of the actual data, and the control unit is arranged to update the control information related to the opening degree of the electric throttle with respect to the operation amount of the operational unit based on the median computed by the median computing unit.

3. A marine vessel running controlling apparatus for a marine vessel which includes a propulsive force generating unit having an engine with an electric throttle as a drive source to generate a propulsive force to propel a hull of the marine vessel, the marine vessel running controlling apparatus comprising:

an operational unit to be operated by an operator of the marine vessel to control the propulsive force; and a control unit arranged to acquire a normal data sample by eliminating an abnormal data sample from actual data acquired during travel of the marine vessel, and update control information related to an opening degree of the electric throttle with respect to an operation amount of the operational unit based on the normal data sample; wherein the control unit includes a trimmed mean computing unit arranged to compute a trimmed mean of the actual data, and the control unit is arranged to update the control information related to the opening degree of the electric throttle with respect to the operation amount of the operational unit based on the trimmed mean computed by the trimmed mean computing unit.

4. A marine vessel running controlling apparatus for a marine vessel which includes a propulsive force generating unit having an engine with an electric throttle as a drive source to generate a propulsive force to propel a hull of the marine vessel, the marine vessel running controlling apparatus comprising:

an operational unit to be operated by an operator of the marine vessel to control the propulsive force; and a control unit arranged to acquire a normal data sample by eliminating an abnormal data sample from actual data acquired during travel of the marine vessel, and update control information related to an opening degree of the electric throttle with respect to an operation amount of the operational unit based on the normal data sample; wherein the control unit includes:

an average computing unit arranged to compute an average of actual data to be processed;

a standard deviation computing unit arranged to compute a standard deviation of the to-be-processed actual data; and a to-be-processed actual data updating unit arranged to update the to-be-processed actual data by eliminating from the to-be-processed actual data an actual data sample deviating from the average by a distance which is not less than a predetermined integer multiple of the standard deviation; wherein the control unit is arranged to update the control information related to the opening degree of the electric throttle with respect to the operation amount of the operational unit based on the to-be-processed actual data updated by the to-be-processed actual data updating unit.

5. A marine vessel running controlling apparatus as set forth in claim 4, wherein the control unit further includes:

an average updating unit arranged to update the average based on the to-be-processed actual data updated by the to-be-processed actual data updating unit; and a standard deviation updating unit arranged to update the standard deviation based on the to-be-processed actual data updated by the to-be-processed actual data updating unit; wherein the to-be-processed actual data updating unit is arranged to further update the to-be-processed actual data based on the average updated by the average updating unit and the standard deviation updated by the standard deviation updating unit.

6. A marine vessel running controlling apparatus as set forth in claim 5, wherein the control unit is arranged to repeatedly cause the average updating unit, the standard deviation updating unit and the to-be-processed actual data updating unit to update the average, the standard deviation and the to-be-processed actual data, respectively, until no actual data sample deviates from the updated average by a distance which is not less than the predetermined integer multiple of the updated standard deviation.

7. A marine vessel comprising:

a hull;

a propulsive force generating unit attached to the hull and including an engine with an electric throttle as a drive source to generate a propulsive force; and a marine vessel running controlling apparatus as recited in claim 1.

8. A marine vessel comprising:

a hull;

a propulsive force generating unit attached to the hull and including an engine with an electric throttle as a drive source to generate a propulsive force; and a marine vessel running controlling apparatus as recited in claim 2.

9. A marine vessel comprising:

a hull;

a propulsive force generating unit attached to the hull and including an engine with an electric throttle as a drive source to generate a propulsive force; and a marine vessel running controlling apparatus as recited in claim 3.

10. A marine vessel comprising:

a hull;

a propulsive force generating unit attached to the hull and including an engine with an electric throttle as a drive source to generate a propulsive force; and a marine vessel running controlling apparatus as recited in claim 4.

* * * * *